US005822669A

United States Patent [19]

Okabayashi et al.

[11] Patent Number: 5,822,669

[45] Date of Patent: Oct. 13, 1998

[54] INDUCTION HEAT FUSING DEVICE

[75] Inventors: Eiji Okabayashi; Takeshi Kato, both of Toyokawa; Satoru Yoneda, Toyohaashi, all of Japan

[73] Assignee: Minolta Co., Ltd., Osaka, Japan

[21] Appl. No.: 695,916

[22] Filed: Aug. 12, 1996

[30] Foreign Application Priority Data

Aug. 29, 1995 [JP] Japan ..... 7-220724
Oct. 9, 1995 [JP] Japan ..... 7-261826

[51] Int. Cl.[6] ..... G03G 15/20

[52] U.S. Cl. ..... 399/330; 219/619; 219/671; 399/122; 399/334

[58] Field of Search ..... 399/122, 328, 399/330, 331, 335, 338, 334; 219/671, 619, 216

[56] References Cited

U.S. PATENT DOCUMENTS 5,074,019 12/1991 Link ..... 219/470 X
5,526,103 6/1996 Kato et al. ..... 219/619 X
5,552,582 9/1996 Abe et al. ..... 219/619
5,568,240 10/1996 Ohtsuka ..... 399/335

*Primary Examiner*—Matthew S. Smith
*Attorney, Agent, or Firm*—Burns, Doane, Swecker & Mathis, LLP

[57] ABSTRACT

An induction heating device for printers, copiers and the like includes a magnetic coil assembly and a heated metal body that form a closed magnetic circuit. To compensate for the effects of heat radiation at the ends of the heated metal body, a greater amount of heat is generated at the ends of the body than at the center thereof. In one approach, the amount of heat is varied by changing physical parameters of the magnetic circuit, such as the spacing of the coil assemblies from the heated body, the relative sizes of the cores, and/or the relative magnetic permeability of the cores. In another approach, the electrical connection of the coils of multiple assemblies are arranged such that the coils in the center of the heated body are in parallel, and the coils at the ends of the body are in series with the parallel central coils.

9 Claims, 19 Drawing Sheets

FIG. 9A
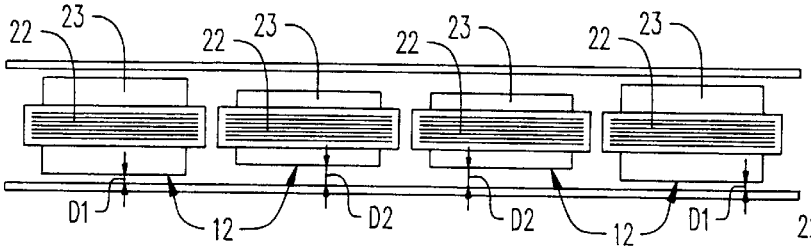
FIG. 9B
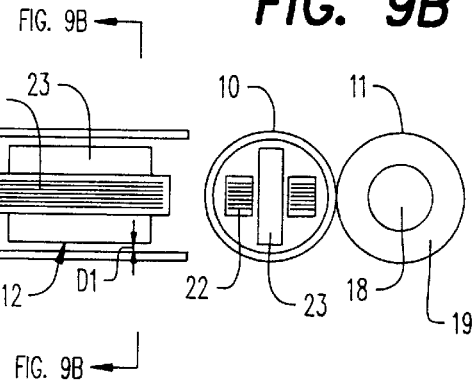
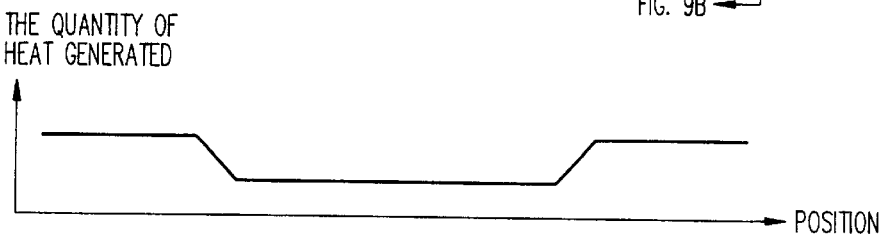
FIG. 9C
FIG. 10A
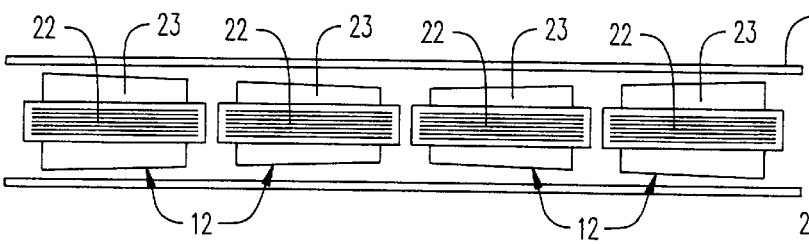
FIG. 10B
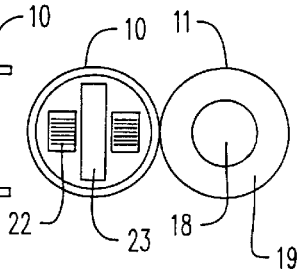
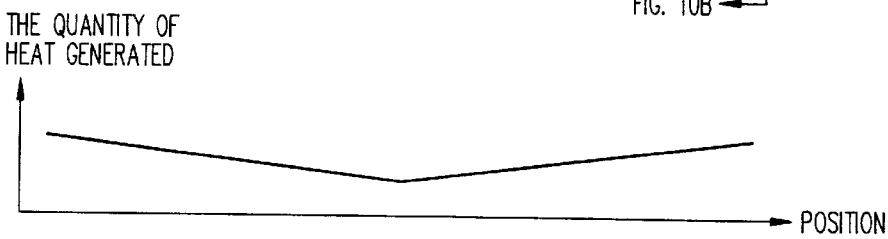
FIG. 10C FIG. 11A
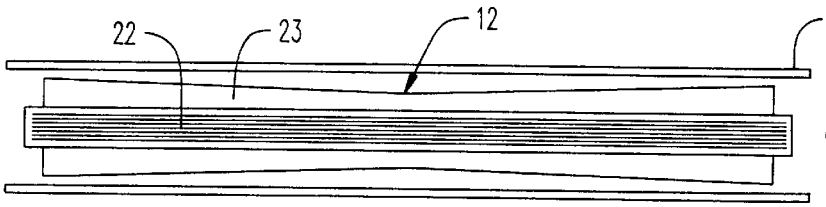
FIG. 11B
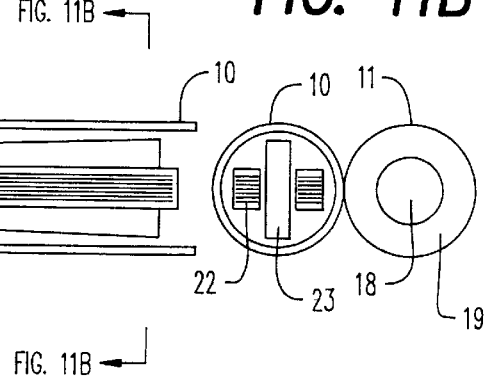
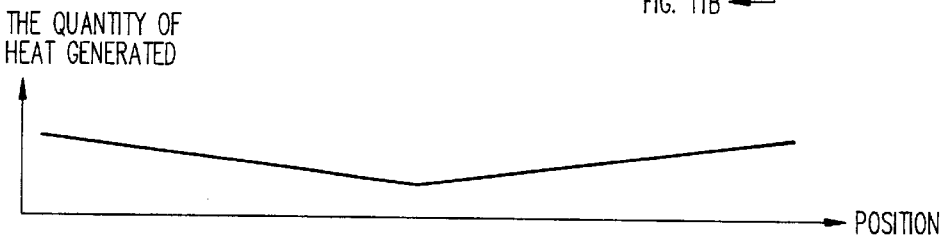
FIG. 11C
FIG. 12A
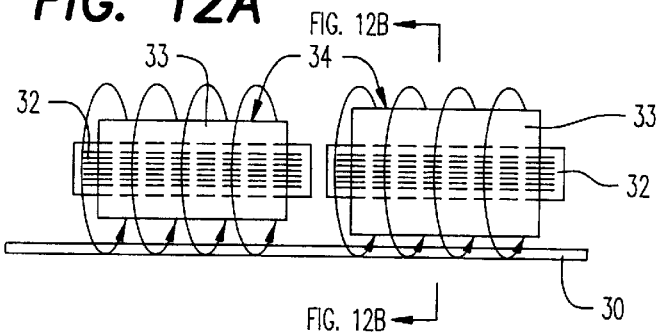
FIG. 12B
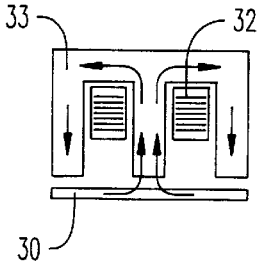

FIG. 13A
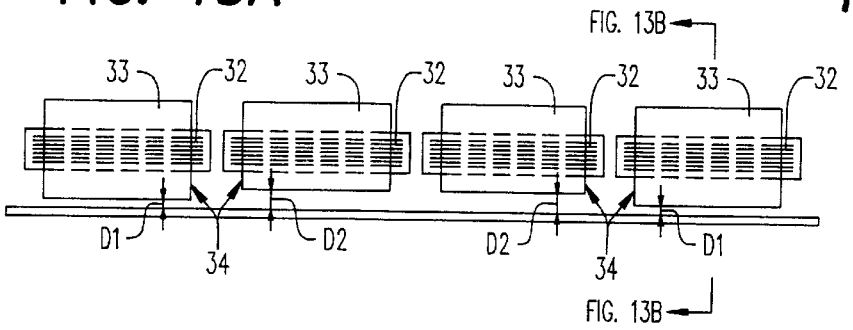
FIG. 13B
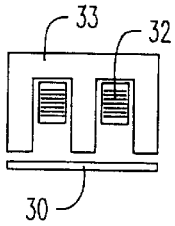
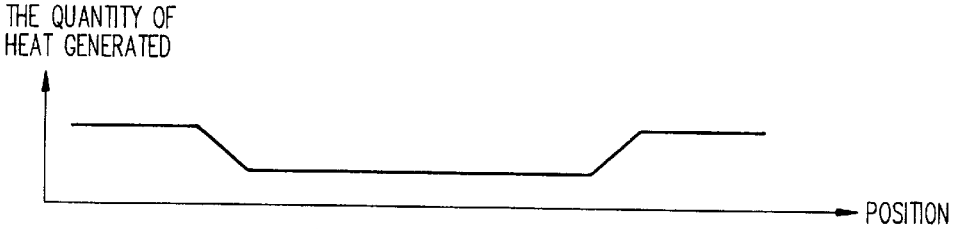
FIG. 13C
FIG. 14A
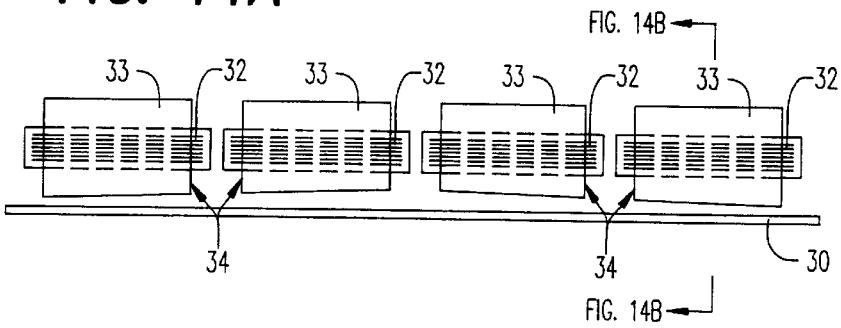
FIG. 14B
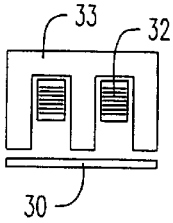
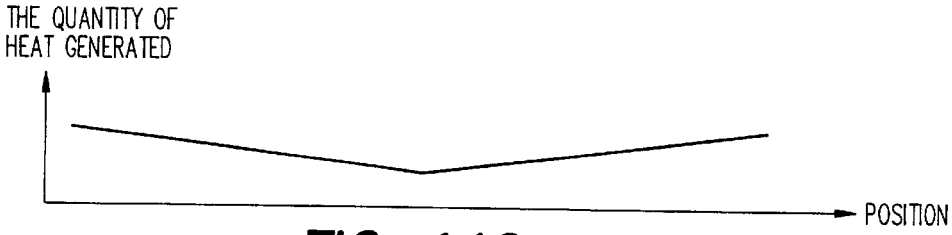
FIG. 14C FIG. 15A
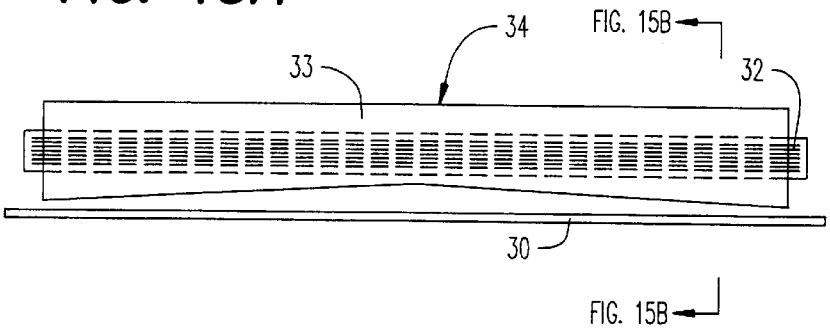
FIG. 15B
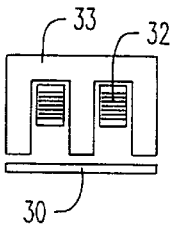
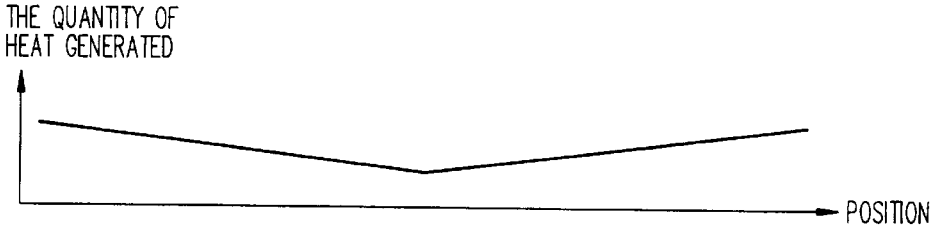
FIG. 15C
FIG. 16A
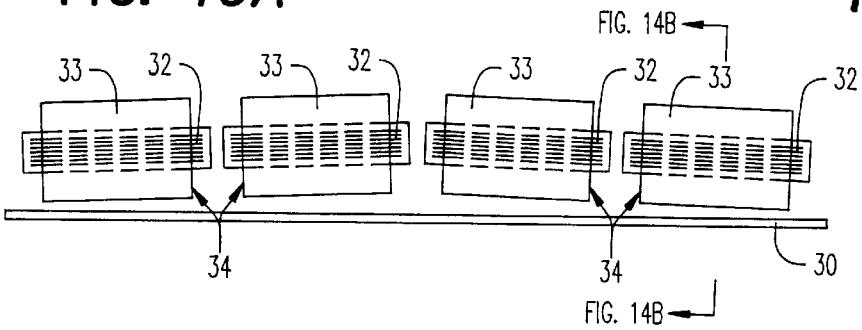
FIG. 16B
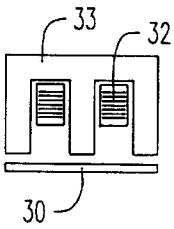
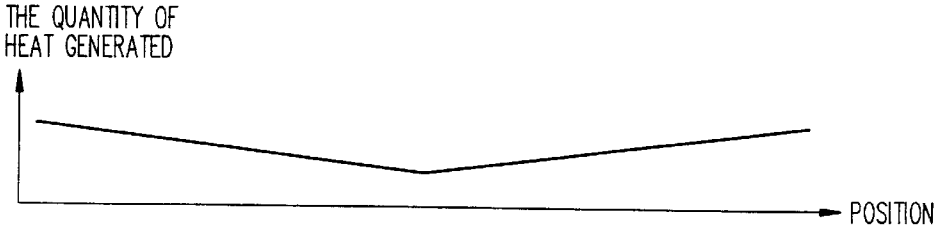
FIG. 16C FIG. 17A
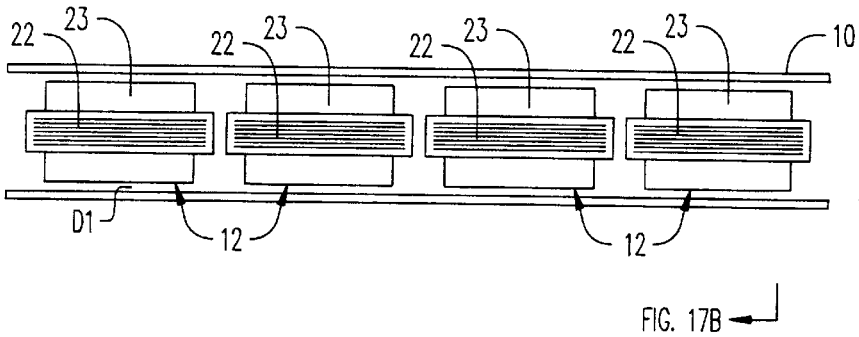
FIG. 17B
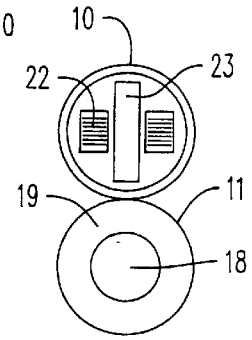
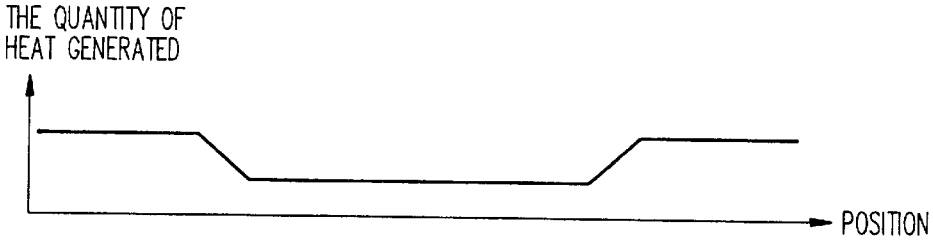
FIG. 17C
FIG. 18A
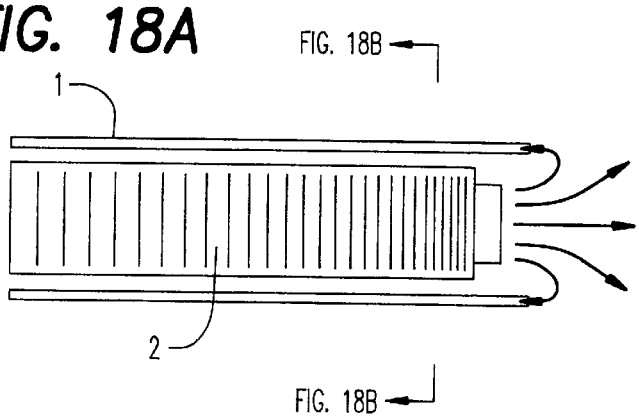
FIG. 18B
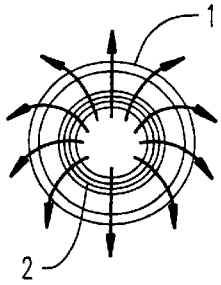

FIG. 19A
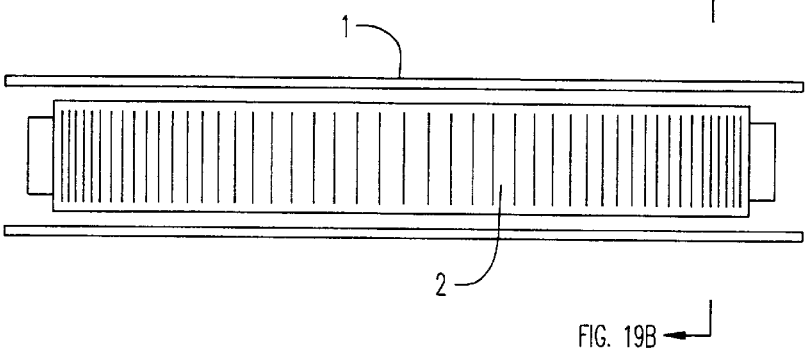
FIG. 19B
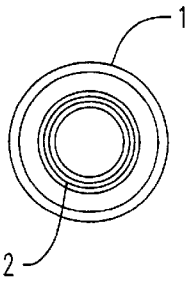
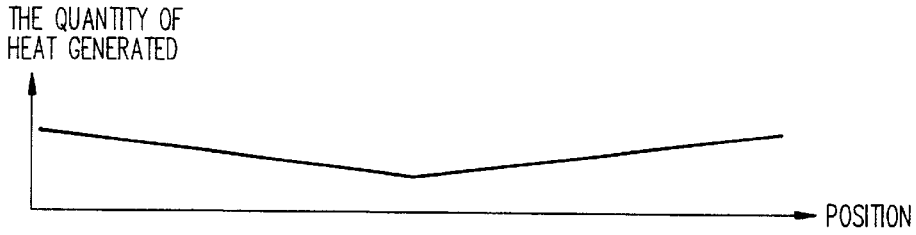
FIG. 19C

FIG. 22A
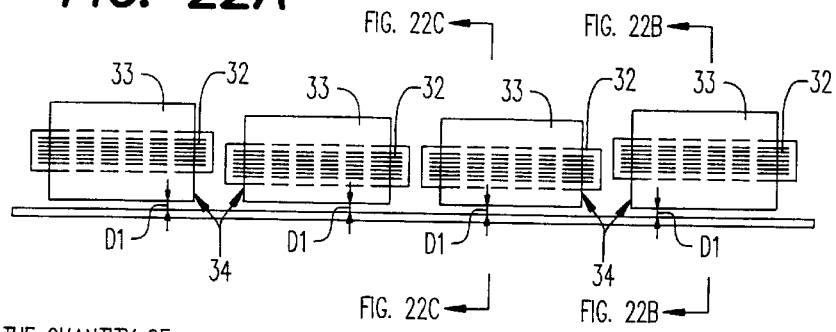
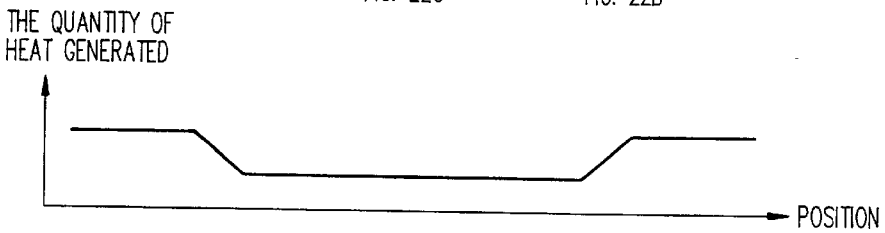
FIG. 22D
FIG. 22B
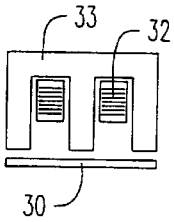
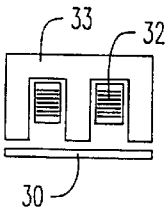
FIG. 22C
FIG. 23A
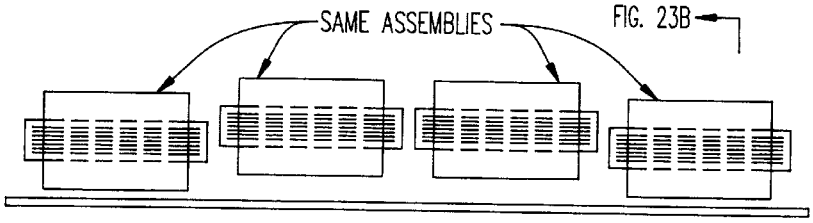
FIG. 23B
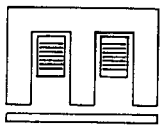
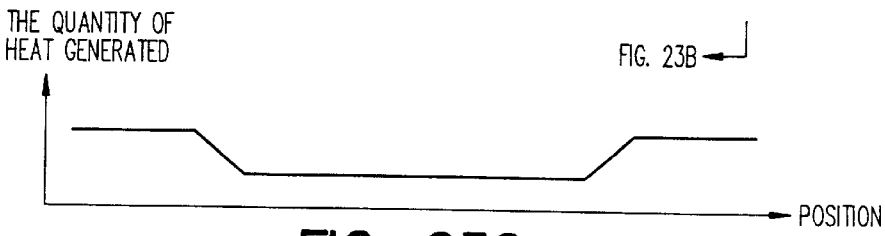
FIG. 23C

INDUCTION HEAT FUSING DEVICE

FIELD OF THE INVENTION

The present invention relates to a fusing device of the type used in electrophotographic copying machines, printers, facsimile machines and so forth, and more particularly to a fusing device that utilizes induction heating to fuse a toner image to a recording medium.

BACKGROUND OF THE INVENTION

Electrophotographic copying machines and the like include a fusing device that fuses a toner image transferred onto a recording medium, such as a sheet of a recording paper or a transfer material. This fusing device typically comprises a fusing roller that thermally fuses toner on a sheet and a pressing roller that presses against the fusing roller to pinch and hold the sheet. The fusing roller is formed in a cylindrical shape, and a heat generating body is retained on the center core of this fusing roller by a retaining means. The heat generating body may be a halogen lamp, for example, and generates heat by means of a fixed voltage applied thereto. Because this heat generating body is positioned at the center core of the fusing roller, heat generated from the heat generating body is uniformly radiated onto the inner wall of the fusing roller, creating a uniform temperature distribution in the circumferential direction on the outer wall of the fusing roller. The temperature of the outer wall of the fusing roller is heated to a temperature suitable for fusing, e.g., 150° to 200° C. In this state, the fusing roller and pressing roller rotate in directions opposite to each other while making contact, to hold the sheet which has toner adhered to it. The toner on the sheet dissolves at the contact portion (hereinafter referred to as the nip portion) between the fusing roller and pressing roller by means of the heat of the fusing roller, and is fused to the sheet by the pressure exerted from both rollers. After the toner adheres, the sheet is fed by a paper delivery roller following the rotation of the fusing roller and pressing roller and is then fed out to a paper delivery tray.

In a fusing device provided with a heat generating body comprised of a halogen lamp, for example, a comparatively long amount of time is required after the power supply is turned ON before the temperature of the fusing roller reaches a temperature suitable for fusing. Problems exist such as operators not being able to use the copying machine and being forced to wait a long time during that warm-up period. In contrast to those problems, when the heating capacity of the fusing roller is increased for the purpose of reducing the waiting time to improve the operability for the users, problems such as increases in the power consumption of the fusing device arise, which work against reductions in energy consumption.

Therefore, in order to increase the value of products such as copying machines, the objective of concurrently reducing energy consumption (lower power consumption) of the fusing devices and improving the operability for users (quick prints) have attracted more and more attention as an important topic. According to this trend, there is a growing demand for reducing not only the toner fusing temperature and the thermal capacity of the fusing roller, but also improving the electricity-to-heat conversion efficiency.

An induction heat fusing device has been proposed in Japanese Laid-open Patent Application Sho 59-33788 as a device to satisfy these requirements. As shown in FIGS. 18A and 18B, this induction heat fusing device has a spirally wound coil 2 concentrically arranged inside a fusing roller 1 comprised of a metal conductor. A high-frequency current flows through the coil 2 in proximity to an inner surface of the fusing roller 1. A high-frequency magnetic field resulting from this current flow causes an induction eddy current in the fusing roller 1, with the skin resistance of the fusing roller causing joule heat generation to occur in the fusing roller 1.

This induction heating method has various advantages compared to other heating methods. The first advantage is quicker temperature increases and less heat generation and heat transfer to portions of the device other than the fusing roller, compared to indirect heating by means of near infrared heat generation of a halogen lamp. Further, there is no loss corresponding to light leakage of the halogen lamp. The second advantage is better heat generation efficiency due to the characteristic skin effect of electromagnetic induction. In addition, the fusing device has greater reliability over an extended period of time, in comparison to surface heating devices having a solid resistance heat generating body on the surface of the fusing roller, which require sliding contacts that are subject to wear due to friction.

Recently, low fusing temperature toners, which melt at a temperature in the range of 110°–130° C., have become available, which provide for lower power consumption and quicker machine warm-up. In addition, the cost of inverter circuit switching devices in residential high-frequency power supplies has been reduced, making it possible to realize induction heat fusing devices having the foregoing desirable characteristics.

In order to achieve uniform fusing performance in the direction of the axis of rotation (lengthwise direction) of the fusing roller in an induction heat fusing device, it is necessary to make the temperature distribution in the direction of the axis of rotation of the fusing roller almost uniform. However, compared to the center portion, the temperature at both ends of the fusing roller is lower because of the influence of heat radiation. Thus, it is generally necessary to make the quantity of heat generated at both ends of the fusing roller higher than the center portion.

Reduced temperature by means of heat radiation at both ends of the fusing roller is addressed in the induction heat fusing device disclosed in Japanese Laid-open Patent Application Sho 59-33788 mentioned above. As shown in FIGS. 19A to 19C, the coil 2 at both ends of the roller is wound denser than the center portion, so that the quantity of heat generated at both ends of the roller is higher than the center portion and the temperature distribution in the direction of the axis of rotation of the fusing roller 1 is almost uniform.

However, because the winding density of the coil 2 changes midway in the lengthwise direction in this arrangement, there is a problem in the ability to mass-produce the coils 2, making it difficult to reduce the cost of the coils.

As further shown in FIGS. 18A and 18B, the winding direction of the coil 2 is identical to the peripheral direction of the fusing roller 1 and, since the generated magnetic flux and fusing roller 1 are in parallel, there is a problem of leakage of the magnetic flux from both ends, thereby decreasing the heat generating efficiency.

SUMMARY OF THE INVENTION

The present invention is directed to a device that solves the foregoing problems which accompany the conventional fuser technology. The object of this invention is to provide an induction heat fusing device with a reduced amount of magnetic flux leakage and good heat generation efficiency that adjusts the distribution of the quantity of heat generated without causing the winding density of the coil to change, thereby allowing the temperature distribution of a fusing roller or metal plate to be almost uniform in the lengthwise direction, in addition to providing a better ability to mass-produce coils.

In order to achieve these objects, the induction heat fusing device of the present invention comprises an induction heat fusing device having a hollow metal roller or a metal heating plate that is a heated metal body, a core arranged at a right angle to the heated metal body and a coil wound on the core so the winding generates a magnetic flux in a direction at a right angle to the heated metal body. The induction heat fusing device further changes the distribution of the quantity of heat generated in the lengthwise direction of the heated metal body by varying one or more parameters of the magnetic circuit which generates the magnetic field across the heated metal body, to thereby vary the amount of heat that is generated.

Because the induction heat fusing device of the present invention causes a magnetic flux to be generated in a direction at a right angle to the heated metal body, leakage of the magnetic flux at both ends of the heated metal body in the lengthwise direction is small, resulting in a higher heat generation efficiency.

In one embodiment of the invention, the distance between the core of the magnetic circuit and the heated metal body is varied. If the distance between the core and the heated metal body is reduced, the magnetic coupling becomes stronger, thereby increasing the quantity of heat generated. If the distance is increased, the magnetic coupling becomes weaker, thereby decreasing the quantity of heat generated. Therefore, even if the winding density of the coil is not changed, the distribution of the quantity of heat generated in the lengthwise direction of the heated metal body can be adjusted as desired by changing the distance between the heated metal body and the core, resulting in an enhanced ability to mass-produce coils.

Because both ends of the heated metal body in the lengthwise direction are easily influenced by heat radiation, with the temperature becoming lower compared to the center portion, the distance between the heated metal body and the core at the edge portion in the lengthwise direction of the heated metal body can be made smaller than the distance between the heated metal body and the core at the center portion. When structured in this way, the temperature distribution in the lengthwise direction of the heated metal body can be made almost uniform, considering the effects of heat radiation, thereby making it possible to achieve uniform fusing characteristics in the lengthwise direction of the heated metal body.

In another embodiment, the induction heat fusing device of the present invention comprises a hollow metal roller or a metal heating plate that is a heated metal body, a plurality of cores arranged at right angles to the heated metal body and a coil wound on each core to generate a magnetic flux in a direction at a right angle to the heated metal body. The induction heat fusing device further changes the distribution of the quantity of heat generated in the lengthwise direction of the heated metal body by arranging cores with different magnetic permeabilities in the lengthwise direction of the heated metal body. Because the induction heat fusing device of the present invention causes a magnetic flux to be generated in a direction at a right angle to the heated metal body, leakage of the magnetic flux at the end of the heated metal body in the lengthwise direction is small, resulting in a higher heat generation efficiency.

Furthermore, because the generated magnetic flux increases as the magnetic permeability of the cores increases, if the magnetic permeability of the cores is made larger, the magnetic flux intertwining with the heated metal body increases and the quantity of heat generated grows larger. If the magnetic permeability of the cores is made smaller, the magnetic flux intertwining with the heated metal body decreases and the quantity of heat generated grows smaller. Therefore, even if the winding density of the coil is not changed, the distribution of the quantity of heat generated in the lengthwise direction of the heated metal body can be adjusted as desired by changing the magnetic permeability of each core arranged in the lengthwise direction of the heated metal body, resulting in an excellent ability to mass-produce coils.

Because the end of the heated metal body in the lengthwise direction is easily influenced by heat radiation with the temperature being lower than the center portion, the magnetic permeability of the cores at the edge portion in the lengthwise direction of the heated metal body can be made larger than the magnetic permeability of the cores at the center portion. When arranged in this way, the temperature distribution in the lengthwise direction of the heated metal body can be made almost uniform, considering the effects of heat radiation, thereby making it possible to achieve uniform fusing characteristics in the lengthwise direction of the heated metal body.

In accordance with another embodiment of the invention, the sizes of the cores which are used to generate the magnetic field are varied. As the size of the core increases, the magnetic field strength increases, even though the number of windings remains the same. Therefore, by utilizing larger cores at the ends of the heated metal body, relative to the cores at the center of the body, a larger amount of heat can be generated at the ends of the body while maintaining a uniform number of windings per core. Thus, the dual objectives of enhanced ability to mass-produce coils and uniform fusing temperature are achieved.

In accordance with another embodiment of the present invention, a plurality of coils for inductively heating the fusing roller are connected to each other through a combination of a parallel connection and a series connection of the coils. With this arrangement, the amount of current which flows through each coil of the plurality of coils differs between the portion of the parallel connection and the portion of the series connection, and consequently the induction current generated in the fusing roller varies. By means of this arrangement, the heat distribution of the fusing roller is made uniform by appropriately combining the parallel connection with the series connection of the coils.

BRIEF DESCRIPTION OF THE DRAWINGS

FIGS. 9A–9C are a transverse view of the fusing roller in the first embodiment as well as a cross-section along line B—B of FIG. 9A and a heat generation distribution drawing, respectively.

FIGS. 10A–10C are a transverse view of the fusing roller in the second embodiment as well as a cross-section along line B—B of FIG. 10A and a heat generation distribution drawing, respectively.

FIGS. 11A–11C are a transverse perspective view of the fusing roller in the third embodiment as well as a cross-section along line B—B of FIG. 11A and a heat generation distribution drawing, respectively.

FIG. 12A is a perspective view of the direction of the magnetic flux generated in the induction heat fusing device in the fourth embodiment and FIG. 12B is a cross-section along line B—B of FIG. 12A.

FIGS. 13A–13C are an elevation view of important parts of the fusing belt in the fourth embodiment as well as a cross-section along line B—B of FIG. 13A and a heat generation distribution drawing, respectively.

FIGS. 14A–14C are an elevation view of the fusing belt in the fifth embodiment as well as a cross-section along line B—B of FIG. 14A and a heat generation distribution drawing, respectively.

FIGS. 15A–15C are an elevation view of important parts of the fusing belt in the sixth embodiment as well as a cross-section along line B—B of FIG. 15A and a heat generation distribution drawing, respectively.

FIGS. 16A–16C are an elevation view of the fusing belt in the seventh embodiment as well as a cross-section along line B—B of FIG. 16A and a heat generation distribution drawing, respectively.

FIGS. 17A–17C are a view of important parts of the fusing roller in the eighth embodiment as well as a cross-section along line B—B of FIG. 17A and a heat generation distribution drawing, respectively.

FIG. 18A is a plan view of the direction of the magnetic flux generated in a conventional induction heat fusing device and FIG. 18B is a cross-section along line B—B of FIG. 18A.

FIGS. 19A–19C are plan views of the fusing roller in a conventional induction heat fusing device as well as a cross-section along line B—B of FIG. 19A and a heat generation distribution drawing, respectively.

FIG. 22A is a side view of the fusing belt and magnetic core assemblies in a ninth embodiment of the invention, FIGS. 22B and 22C are cross-sectional views along section lines $B_1$–$B_2$ and $B_2$–$B_2$ of FIG. 22A, respectively, and FIG. 22D is a graph of heat generation distribution.

FIG. 23A is a side view of the fusing belt and magnetic core assemblies in a tenth embodiment of the invention, FIG. 23B is a cross-sectional view along section line B—B of FIG. 23A, and FIG. 23C is a graph of heat generation distribution.

DETAILED DESCRIPTION

Figure 1:
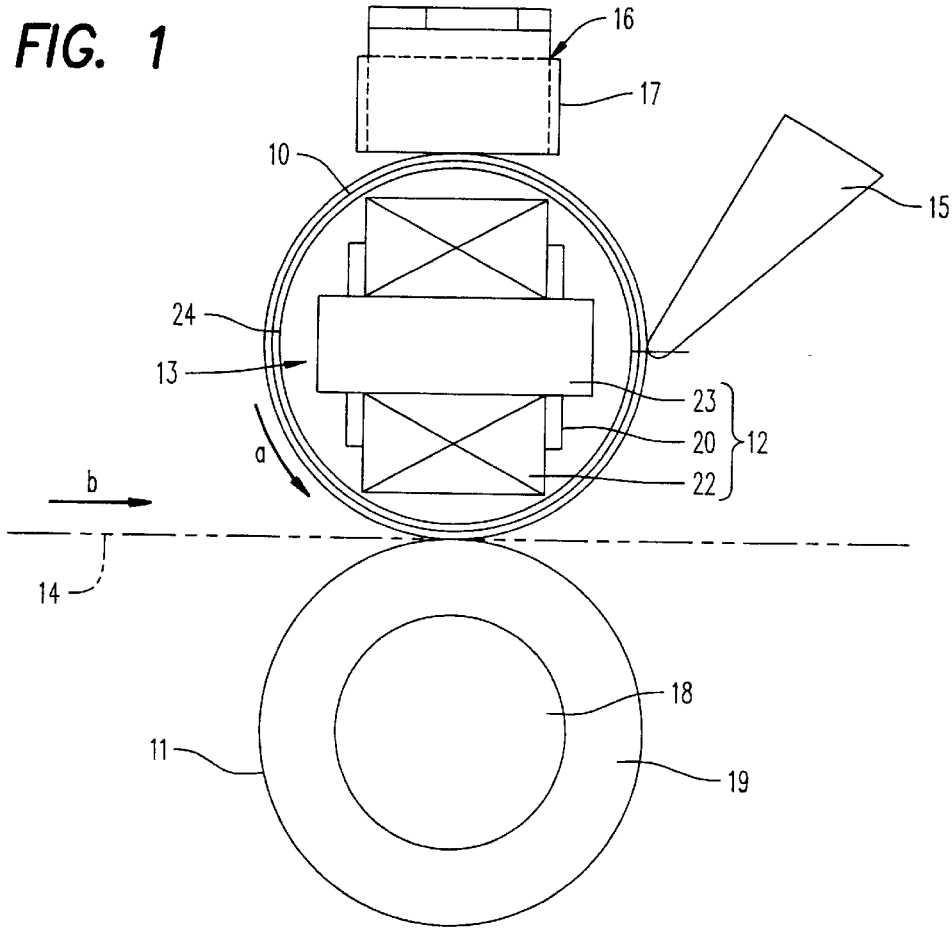
FIG. 1 is a cross-section of an induction heat fusing device of a type to which the present invention can be applied.
Figure 2:
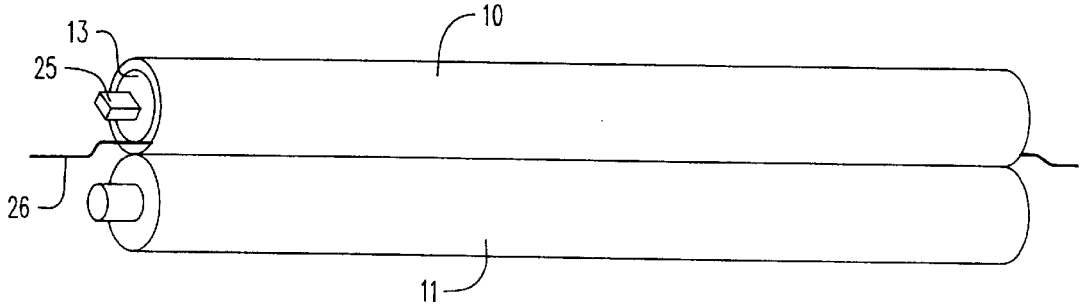
FIG. 2 is a perspective view of the fusing roller and the pressing roller used in the induction heat fusing device shown in FIG. 1.

FIG. 1 is a cross-section of an induction heat fusing device that can employ the present invention, and FIG. 2 is a perspective view of the fusing roller and the pressing roller shown in FIG. 1.

As shown in FIG. 1, an induction heat fusing device incorporated in devices such as printers has a heat roller, or more precisely, a fusing roller 10 provided such that it can rotate in the direction of arrow a, and a pressing roller 11 that presses against the fusing roller 10 and is driven to rotate following the rotation of the fusing roller 10. The fusing roller 10 is a hollow pipe of a conductive material, and inside this pipe a plurality of coil assemblies 12 are arranged which cause an induction current (eddy current) to be generated in the fusing roller 10. Each coil assembly 12 is retained in a holder 24 and comprises a holder unit 13. The fusing roller 10 itself is what generates heat by means of the induction current and this fusing roller 10 comprises the heated metal body of the fusing device.

The fusing roller 10 has a sliding bearing portion formed on both ends and is mounted on a fusing unit frame (not shown in the figure) to freely rotate. The fusing roller 10 has a drive gear (not shown in the figure) fixed to one end and is driven to rotate by a drive source (not shown in the figure) such as a motor which is connected to this drive gear. The holder unit 13 maintains a gap at a fixed dimension with the inner peripheral surface of the fusing roller 10 and is housed inside the fusing roller 10. This holder unit 13 is fixed to the fusing unit frame and does not rotate.

A toner support member onto which is transferred a toner image that has not yet been fused, such as a sheet 14, is fed from the left side as indicated by arrow b in FIG. 1 and sent to the nip portion between the fusing roller 10 and the pressing roller 11. While the heat of the fusing roller and the pressure exerted from both rollers 10, 11 are being applied, the sheet 14 is fed through the nip portion. The toner is fused by this action and a fused toner image is formed on the sheet 14. The sheet 14 that has passed through the nip portion naturally separates from the fusing roller 10 by means of the curvature of the fusing roller itself 10 or, as shown in FIG. 1, is forcibly separated from the fusing roller 10 by means of either a separation claw 15 or separation guides provided such that the leading edge portion makes contact with the surface of the fusing roller 10 and then the sheet is fed in a direction to the right in FIG. 1. This sheet 14 is fed by a paper delivery roller (not shown in the figure) and delivered to a paper delivery tray.

A temperature sensor 16 that detects the temperature of the fusing roller 10 is provided above the fusing roller 10. This temperature sensor 16 is located on the side of the fusing roller 10 opposite a coil 22, and presses against the surface of the fusing roller 10. The temperature sensor 16 comprises, for example, a thermistor. While the temperature of the fusing roller 10 is detected by this thermistor 16, the flow of electricity to the coil 22 is regulated to ensure an optimum temperature of the fusing roller.

A thermostat 17 is further provided above the fusing roller 10 as a safety mechanism when the temperature rises abnormally. This thermostat 17 presses against the surface of the fusing roller 10 and when the temperature reaches a previously set value, its contacts open to cut off the flow of electricity to the coil 22. This prevents the temperature of the fusing roller 10 from reaching more than a fixed value.

The fusing roller 10 is formed from a conductive member such as iron, a stainless steel alloy tube, nickel, a carbon steel tube or an aluminum alloy tube. Preferably, the material which is used to form the fusing roller also has magnetic properties. The outer peripheral surface of this member is coated with a fluororesin and a heat resistant separation layer is formed on the surface. The pressing roller 11 comprises a silicon rubber layer 19, which forms a surface separation heat resistant rubber layer, on the periphery of a shaft core 18. The sliding bearing and separation claw 15 are formed from a heat resistant slidable engineered plastic.

Figure 3:
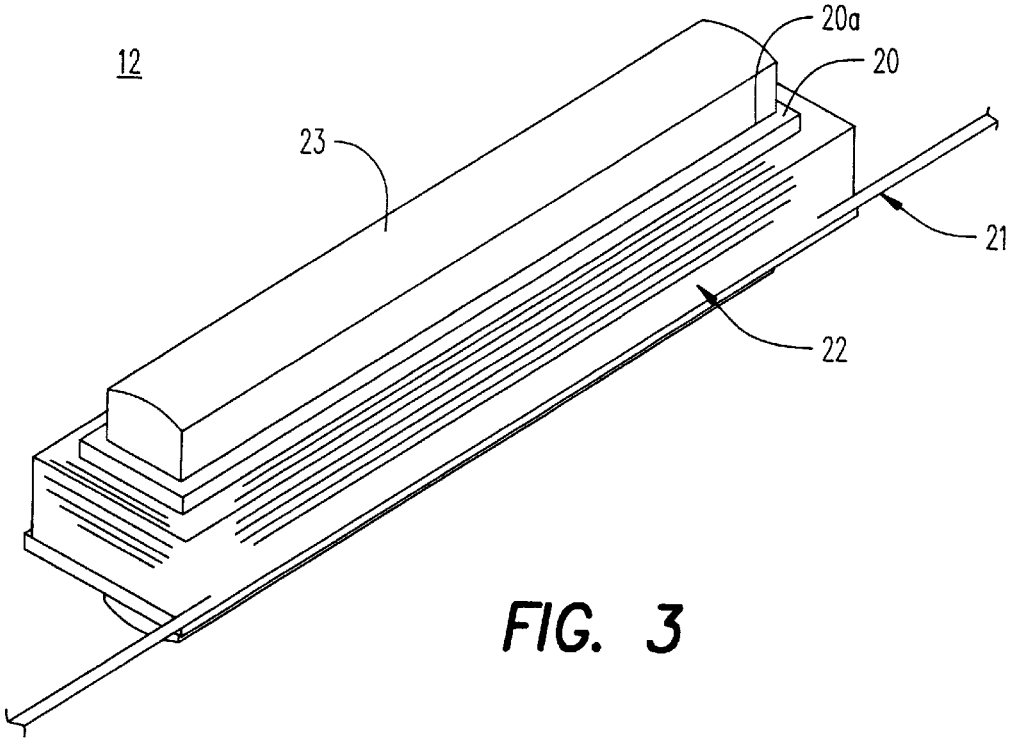
FIG. 3 is a perspective view of the coil assembly used in the induction heat fusing device shown in FIG. 1.

As shown in FIG. 3, a coil assembly 12 has a square-shaped bobbin 20 that forms a through-hole 20*a* in the center portion. A copper wire 21 is wound around this bobbin 20 several times in one direction to form a coil 22. A core 23 is inserted in the through-hole 20*a* of the bobbin 20 at a right-angle to the copper wire 21 of the coil 22. The bobbin 20 can be formed from, for example, a ceramic or heat resistant insulating engineered plastic and, for the coil 22, it is preferable to use a single or a Litz wire having a fusing layer and insulating layer on the surface. The core 23 is comprised, for example, of a ferrite core or a laminated layer core.

Figure 4:
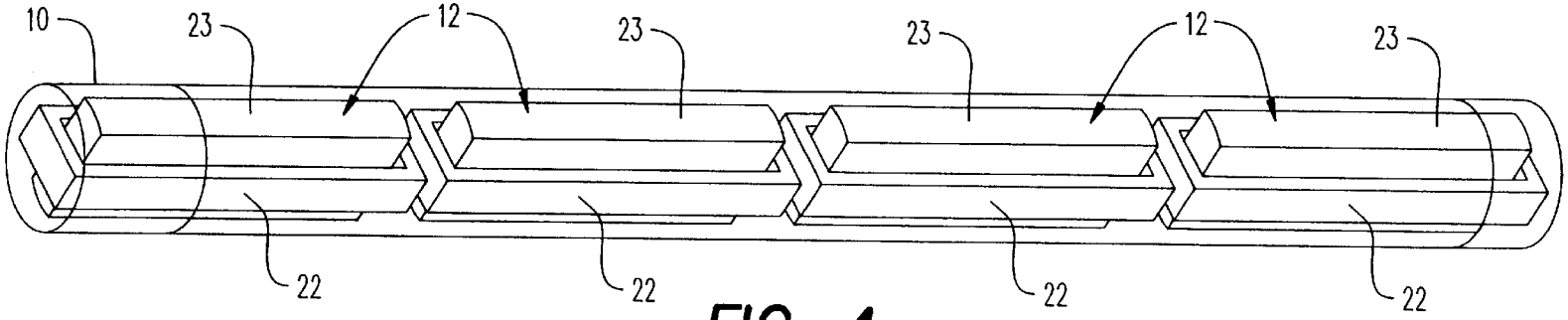
FIG. 4 is a perspective view of the coils and cores inside the fusing roller.

FIG. 4 is a perspective view of the coils 22 and the cores 23 inside the fusing roller 10. In this embodiment, four coil assemblies 12 are arranged to generate a magnetic flux in a direction at a right angle to the direction of the axis of rotation, that is the lengthwise direction of the fusing roller 10. The assemblies are also arranged so the copper wire 21 wound around the bobbin 20 lies along a plane parallel to the axis of rotation of the fusing roller 10 or, in other words, in a direction so the core 23 is at a right angle to the axis of rotation.

Figure 5:
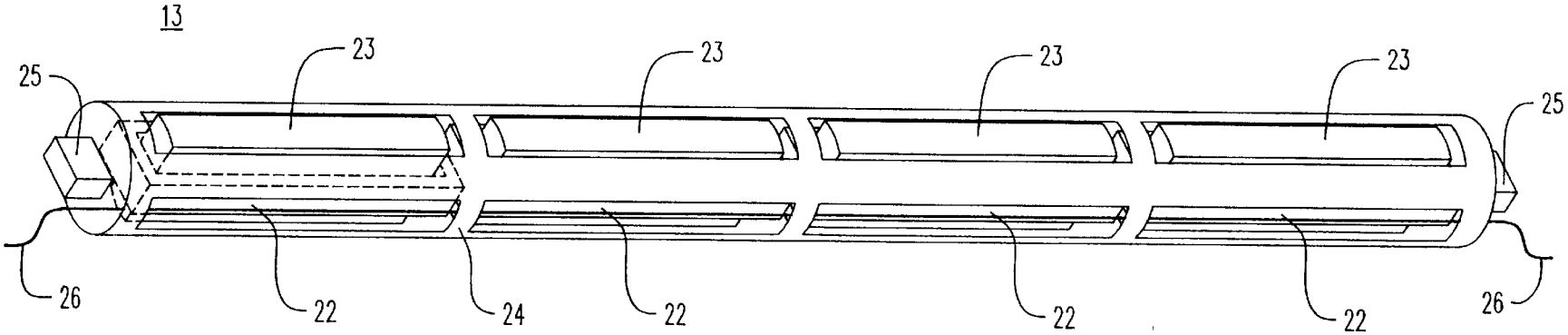
FIG. 5 is a perspective view of the holder unit that retains the coil assembly shown in FIG. 3 inside the fusing roller.

Further, as shown in FIGS. 1 and 5, in this embodiment, the plurality of coil assemblies 12 are arranged in the holder 24 so that they are lined up in the direction of the shaft of the fusing roller 10, so their cores 23 are parallel to the feed direction of the sheet 14 and the coil 22 of each assembly is opposite the pressing roller 11. This holder 24 is formed from a heat resistant insulating engineered plastic and, as shown in FIG. 5, is shaped with a plurality of open holes penetrating the periphery of the cylinder from the top to the bottom and from the left to the right. The holder is further provided with protruding portions 25 at both ends to secure it to the fusing unit frame. The coil assemblies 12 can be incorporated in the holder 24, for example, by inserting bobbins 20 into holes provided around the holder 24 in the right-left direction and thereafter inserting the cores 23 into holes provided in the top-bottom direction. The plurality of coils 22 are connected in series inside the holder 24 and a lead wire 26 (FIG. 5) is drawn through both ends of the holder 24 to allow electrical current to flow to these coils 22. The holder unit 13 has an external diameter slightly smaller than the inner diameter of the fusing roller 10, to form a gap with the inner wall of the fusing roller 10.

Figure 6:
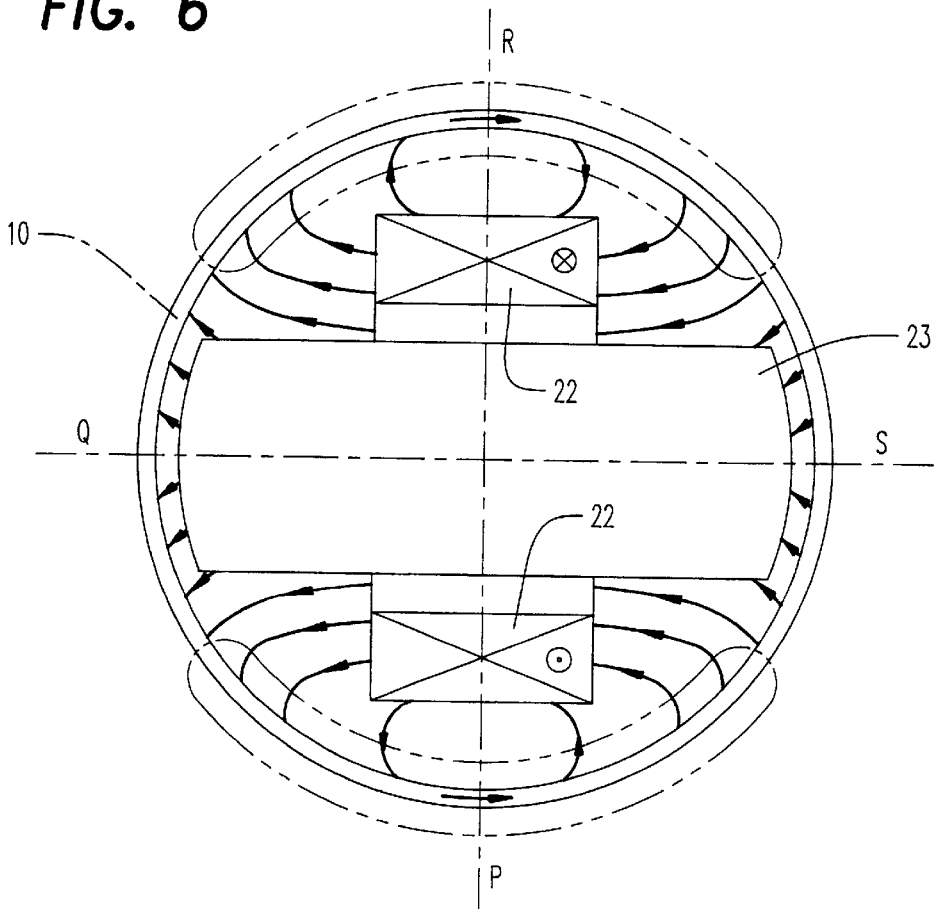
FIG. 6 is an explanatory drawing to describe the heating principle of the fusing roller in the induction heat fusing device shown in FIG. 1.

FIG. 6 is an explanatory drawing to describe the heating principle of the fusing roller 10 in an induction heat fusing device in which this invention is applied. As shown in the figure, when a high-frequency electric current (from a few kHz to tens of kHz) flows through the coil 22, a magnetic flux is generated from the core 23 at a right angle to the lengthwise shaft direction of the fusing roller 10, following Ampere's "right-hand rule." This magnetic flux is also a high-frequency magnetic flux.

The magnetic flux that reaches the fusing roller 10 of the conductor curves along the fusing roller 10, becoming a magnetic flux that passes through the inside of the circular peripheral surface of the fusing roller 10 at a rate dependent on the relative magnetic permeability of the conductor. The density of the magnetic flux concentrated at the peripheral surface of the fusing roller 10 is largest at the portions opposite the coil 22.

Following Lentz's Rule, the action of this concentrated magnetic flux generates a vortex-shaped induction current in the fusing roller 10 within the inner wall, which causes a counter magnetic flux to be generated with a direction opposite to this magnetic flux, which inhibits the original magnetic flux from the coil assembly. Because this induction current is converted to joule heat by means of the skin resistance of the fusing roller 10, the fusing roller 10 generates heat.

In this composition, the magnetic flux density within the peripheral surface at points P, R of the fusing roller 10 is highest, and in contrast to this, is lower at points Q, S. Consequently, because the induction current density tends to change in a like manner as well, the heat generation of the fusing roller 10 may not be uniform around the peripheral surface, with heat being locally higher at the portions surrounded by the two dot-dash lines. If these portions where the heat is locally higher are shown in FIG. 1, they are equivalent to the top region and the bottom region of the fusing roller 10. Therefore, at least one portion of the nip portion and one side of the heat generation will be overlapping. Furthermore, the thermistor 16 makes contact with the other locally heated region and the thermostat 17 is also arranged to make contact with, or be in proximity to, the region. The mounting location of the thermistor 16 can be either above or below the fusing roller 10. In the embodiment shown in the figure, the thermistor is mounted on the outside above the roller. Further, if the thermistor 16 is a small, compact type, is can be mounted on the inside above or below the fusing roller 10.

Figure 7A:
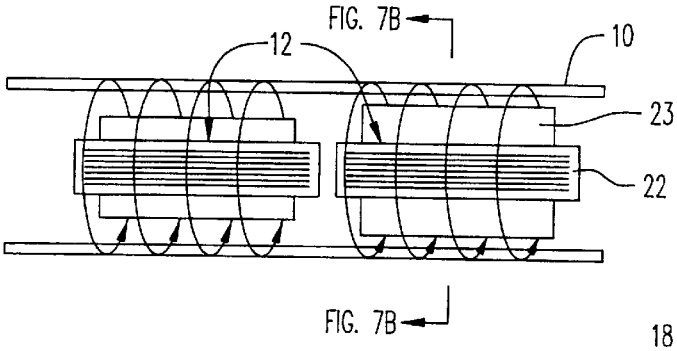
FIG. 7A is a transverse perspective view of the direction of the magnetic flux generated in the induction heat fusing device shown in FIG. 1.
Figure 7B:
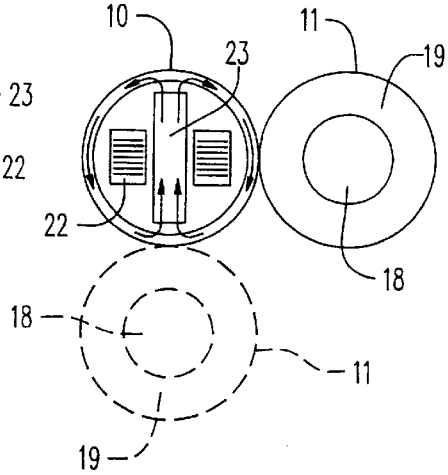
FIG. 7B is a cross-section along line B—B of FIG. 7A.

As shown in FIGS. 7A and 7B in this embodiment, the core 23 of each coil assembly 12 is arranged in a direction at a right angle to the fusing roller 10 and the coil 22 is arranged such that it is wound about an axis that is at a right angle to the axis of rotation of the fusing roller 10. Thereby, the direction of the generated magnetic flux is in a direction at a right angle to the fusing roller 10, resulting in the fusing roller 10 and the core 23 creating a closed magnetic circuit. Because of this, there is either no leakage of magnetic flux from both ends of the fusing roller 10, or it is small, thereby increasing the heat generating efficiency.

As illustrated in FIG. 7B, the pressing roller 11 can be located in the dotted line position in which it is positioned opposite one of the ends of the core 23, for the reasons indicated previously. However, in situations where the heat is generally uniform around the circumference of the fusing roller 10, the pressing roller can alternatively be located at the solid line position, opposite the coil 22.

Figure 8:
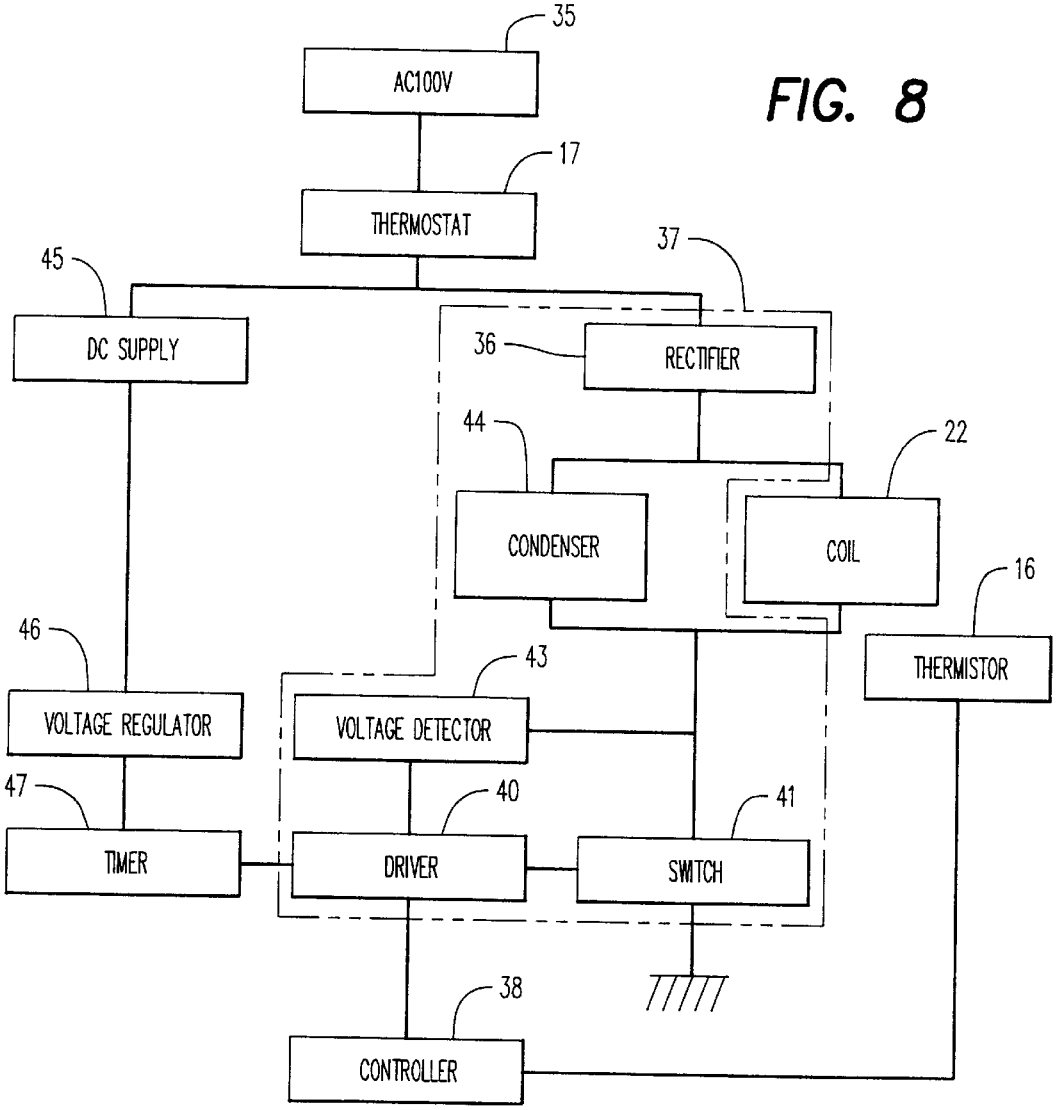
FIG. 8 is a block diagram of the circuit through which the high-frequency current flows to the induction heating coil and which controls the temperature of the fusing roller.

FIG. 8 is a block diagram of the circuit through which the high-frequency current flows to the induction heating coil 22, to control the temperature of the fusing roller 10. Since it is necessary for a high-frequency electrical current to flow in an induction heat fusing device in order to increase the heat generating efficiency, means are taken to smoothly rectify the alternating current of a commercial power supply and invert it to produce a high frequency. That is, the high-frequency electrical current is generated by rectifying alternating current of a commercial power supply 35 by means of a rectification circuit 36 and inverting it to a high frequency using an inverter circuit 37.

The thermostat 17 functions as a safety device if the inversion action between the commercial power supply 35 and the circuit begins to operate out-of-control. The electrical current flowing to the induction heating coil 22 is supplied through the thermostat 17 that is pressing against the surface of the fusing roller 10, and if the surface temperature of the fusing roller 10 reaches a previously set abnormal temperature value, the electrical circuit is opened by the thermostat 17. A control circuit 38 comprised of a microprocessor and memory carries out temperature control based on the electric potential of the thermistor 16, while monitoring the temperature of the fusing roller 10. The control circuit 38 carries out the temperature control by outputting an ON/OFF signal to a drive circuit 40 inside the inverter circuit 37. The inverter circuit 37 carries out frequency conversion on direct current from the rectification circuit 36, converting it to a high-frequency electrical current, and supplies it to the coil 22.

In the inverter circuit 37, when the control signal generated from the control circuit 38 turns ON, at first, the drive circuit 40 activates the switching device 41 and a voltage is applied to an LC resonant circuit comprised of the induction heating coil 22 and a resonance condenser 44. This action causes an electrical current to flow in the induction heating coil 22. The switch-on time is determined by a timer circuit 47. The timer circuit 47 turns on the switching device 41 to obtain a stable heating output only during a fixed time that is determined by an RC charge and discharge property using a voltage regulator 46. When the set time is reached, a signal is sent to the drive circuit 40 to turn the switching device 41 OFF. When switching device 41 turns off, a resonant electrical current flows between the induction heating coil 22 and the resonance condenser 44. Thereafter, when a voltage detection circuit 43 detects that the drain voltage on the induction heating coil 22 side of the switching device 41 drops close to 0 V by means of the resonance, a signal is sent to the drive circuit 40 to turn on the switching device 41 again. Basically, the switch-off time is determined by the voltage detection circuit 43. By repeating this switching cycle, a high-frequency electrical current flows to the induction heating coil 22.

Furthermore, a DC power supply 45 for the circuit is provided, which is a simple stabilized power supply to supply a direct current to the timer circuit 47, drive circuit 40, voltage detection circuit 43 and the voltage regulator 46.

As stated above, because the temperature at both ends of the fusing roller 10 are lower, compared to the center portion, due to the influence of heat radiation, if the quantity of heat generated at both ends of the fusing roller 10 is not higher compared to the center portion, the temperature distribution in the lengthwise direction of the fusing roller 10 is not uniform, making it difficult to achieve uniform fusing performance in the lengthwise direction. To compensate for this effect, in one embodiment of the invention shown in FIGS. 9A and 9B, the distribution of the quantity of heat generated in the lengthwise direction of the fusing roller 10 is varied by changing the distance between the fusing roller 10 and the core 23. The distance between the fusing roller 10 and the core 23 at the edge portion in the lengthwise direction of the fusing roller 10 is smaller than the distance at the center portion. In other words, the air gap D1 between the cores 23 at the two outside coil assemblies 12 and the inner surface of the fusing roller 10 is smaller than the air gap D2 at the two inside coil assemblies 12. In this embodiment, the variation in distance is achieved by making the cores on the outside larger than the cores on the interior.

If the distance between the fusing roller 10 and the core 23 is made smaller, the magnetic coupling becomes stronger, thereby increasing the quantity of heat generated. If the distance is made larger, the magnetic coupling becomes weaker, thereby decreasing the quantity of heat generated. Therefore, even if the winding density of the coil 22 is not changed, the distribution of the quantity of heat generated in the lengthwise direction of the fusing roller 10 can be adjusted as desired by only changing the distance between the fusing roller 10 and the core 23. Further, because the coil 22 is constructed using a uniform winding density, the ability to mass-produce coils is improved, allowing reductions in the cost of the coils 22.

Because the air gap D1 at the two outside coil assemblies 12 is smaller than the air gap D2 at the two inside coil assemblies 12, the distribution of the quantity of heat generated in the lengthwise direction of the fusing roller 10 is as shown in FIG. 9C. Assuming this type of distribution of the quantity of heat, even though the edge portion in the lengthwise direction of the fusing roller 10 is easily influenced by heat radiation, the temperature distribution in the lengthwise direction of the fusing roller 10 can be made almost uniform, thereby making it possible to achieve uniform fusing characteristics in the lengthwise direction of the fusing roller 10.

FIGS. 10A–10C, respectively, comprise a transverse view of the fusing roller in a second embodiment of the invention, a cross-section along line B—B of FIG. 10A, and a heat generation distribution drawing. To the extent that a fusing roller 10 and a plurality of coil assemblies 12 are used, this second embodiment is similar to the above-mentioned first embodiment. However, the second embodiment is different in the fact that it continuously changes the quantity of heat generated, while the first embodiment changes the quantity of heat in a stepwise manner.

As shown in FIG. 10A, the surfaces of the top and bottom edges of each core 23 in the figure are inclined surfaces, making the air gap gradually smaller from the center portion of the fusing roller 10 toward the edge portion. When constructed this way, the distribution of the quantity of heat generated in the lengthwise direction of the fusing roller 10 is as shown in FIG. 10C. Thus, the quantity of heat generated in the lengthwise direction of the fusing roller 10 continuously changes.

In the second embodiment as well, since the magnetic flux is generated in a direction at a right angle to the fusing roller 10, the leakage of magnetic flux from both ends of the fusing roller 10 is small, and the heat generating efficiency is increased. The temperature distribution in the lengthwise direction of the fusing roller 10 can be made almost uniform, thereby making it possible to further achieve uniform fusing characteristics in the lengthwise direction of the fusing roller 10.

FIGS. 11A–11C, respectively, comprise a transverse view of the fusing roller in a third embodiment of the invention, a cross-section along line B—B of FIG. 11A and a heat generation distribution drawing. Due to the fact that a fusing roller 10 is used and the quantity of heat generated is continuously changed, the third embodiment is similar to the second embodiment. However, the third embodiment is different with respect to the fact that it uses one comparatively long coil assembly 12, while the second embodiment uses four comparatively short coil assemblies 12.

As shown in FIG. 11A, the surfaces of the top and bottom edge of one comparatively long core 23 in the figure are inclined surfaces, making the air gap gradually smaller from the center portion of the fusing roller 10 toward the edge portion. When constructed this way, the distribution of the quantity of heat generated in the lengthwise direction of the fusing roller 10 is as shown in FIG. 11C. In the third embodiment as well, the heat generating efficiency is increased and uniform fusing characteristics in the lengthwise direction of the fusing roller 10 can be achieved.

Induction heat fusing devices can alternatively use a fusing belt that is comprised of a conductive member, such as metal, and that carries out the transfer while making contact with the recording paper, in place of the fusing roller 10. An induction heating coil arranged opposite the fusing belt causes joule heat generation in the fusing belt itself. This fusing belt is equivalent to a metal heating plate.

Figure 20:
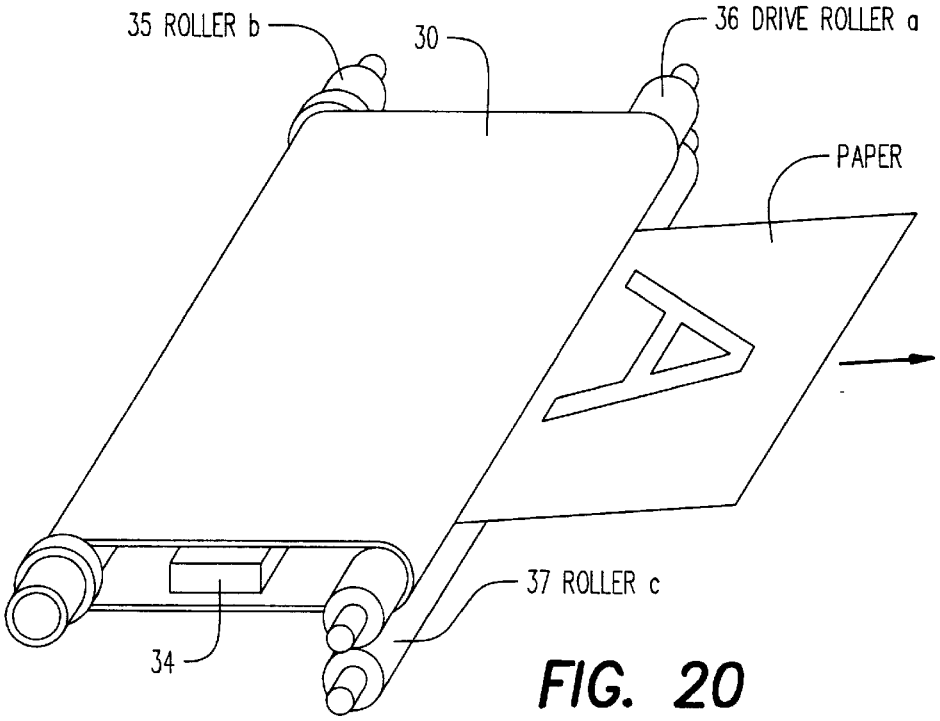
FIGS. 20 and 21 are a perspective view and a side view, respectively, of an embodiment of a fusing device which utilizes a fusing belt.
Figure 21:
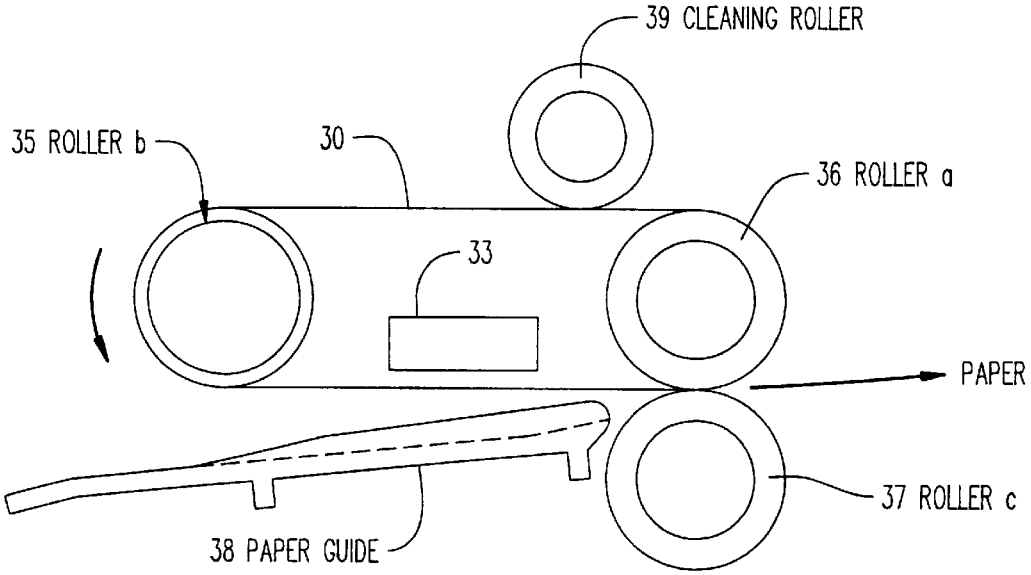

An arrangement for a fusing device which utilizes a fusing belt is shown in FIGS. 20 and 21. Referring thereto, a fusing belt 30 which includes a layer of conductive material, such as metal, is wound about a pair of rollers 35 and 36. The roller 35 is a drive roller which is connected to a suitable drive mechanism (not shown), and drives the belt in the direction of the arrow illustrated in FIG. 21. A pressing roller 37 is located opposite the roller 36 and in contact with the fusing belt 30, to form a nip through which a sheet of paper, or other record medium carrying an unfused toner image, passes. The sheet of paper is guided into the nip by a paper guide 38 shown in FIG. 21.

An inductive heating coil assembly 33 is located within the interior of the belt, between the two rollers 35 and 36. This coil assembly causes the belt 30 to be heated as it advances towards the nip formed by the rollers 36 and 37. As the paper passes through the nip the image is fused onto it, as depicted in FIG. 20. A cleaning roller 39 is located above the belt 30, and functions to remove any toner particles which may have adhered to the belt.

As shown in FIGS. 12A–12B, in an induction heat fusing device that uses a fusing belt 30, the core 33 of each coil assembly 34 is arranged at a right angle to the fusing belt 30 and the coil 32 is arranged such that it is wound around a central shaft that is disposed at a right angle to the fusing belt 30. In like manner to the previous embodiments, the direction of the generated magnetic flux is in a direction at a right angle to the fusing belt 30, resulting in the fusing belt 30 and the core 33 creating a closed magnetic circuit. Because of this, there is either no leakage of magnetic flux the edges of the fusing belt 30, or it is small, thereby increasing the heat generating efficiency.

FIGS. 13A–13C, respectively, comprise a transverse view of the main parts of the fusing belt in a fourth embodiment of the invention, a cross-section along line B—B of FIG. 13A, and a heat generation distribution drawing. This fourth embodiment is similar to the first embodiment except for the fact that a fusing belt 30 is used in place of the fusing roller 10.

As shown in FIG. 13A, the air gap D1 at the two outside coil assemblies 34 is smaller than the air gap D2 at the two inside coil assemblies 34. When constructed this way, the distribution of the quantity of heat generated in the crosswise direction of the fusing belt 30 is as shown in FIG. 13C. In this fourth embodiment, because the magnetic flux is generated in a direction at a right angle to the fusing belt 30, the leakage of magnetic flux from both ends of the fusing belt 30, as viewed in the crosswise direction, is small and the heat generating efficiency is increased. The temperature distribution in the crosswise direction of the fusing belt 30 is made almost uniform, thereby making it possible to further achieve uniform fusing characteristics in the crosswise direction of the fusing belt 30.

FIGS. 14A–14C are views of the main parts of the fusing belt in a fifth embodiment of the invention. This fifth embodiment is similar to the second embodiment, except for the fact that a fusing belt 30 is used in place of the fusing roller 10. As shown in FIG. 14A, the surface of the bottom edge of each core 33 in the figure is an inclined surface, making the air gap gradually smaller from the center portion of the fusing belt 30 toward the longitudinal edges. When constructed this way, the distribution of the quantity of heat generated in the crosswise direction of the fusing belt 30 is as shown in FIG. 14C. In this embodiment, the quantity of heat generated in the crosswise direction of the fusing belt 30 changes continuously. In the fifth embodiment as well, the heat generating efficiency is increased and uniform fusing characteristics in the crosswise direction of the fusing belt 30 can be achieved.

FIGS. 15A–15C are views of a sixth embodiment of the invention. This sixth embodiment is similar to the third embodiment, except for the fact that a fusing belt 30 is used in place of the fusing roller 10. As shown in FIG. 15A, the surface of the bottom edge of one comparatively long core 33 in the figure is an inclined surface, making the air gap gradually smaller from the center portion of the fusing belt 30 toward the longitudinal edges. When constructed this way, the distribution of the quantity of heat generated in the crosswise direction of the fusing belt 30 is as shown in FIG. 15C. In the sixth embodiment, therefore, the heat generating efficiency is increased and uniform fusing characteristics in the crosswise direction of the fusing belt 30 can be achieved.

FIGS. 16A–16C are views of the main parts of a seventh embodiment of the invention. This seventh embodiment uses multiple coil assemblies 34, e.g., four coil assemblies, each of which has the same composition. As shown in FIG. 16A, each coil assembly 34 is arranged to be inclined relative to the fusing belt 30 so the air gap gradually becomes smaller from the center portion of the fusing belt 30 toward the longitudinal edges. When constructed this way, the distribution of the quantity of heat generated in the crosswise direction of the fusing belt 30 is as shown in FIG. 16C. In this embodiment, the quantity of heat generated in the crosswise direction of the fusing belt 30 changes continuously. The heat generating efficiency is increased and uniform fusing characteristics in the crosswise direction of the fusing belt 30 can be achieved.

FIGS. 17A–17C are views of the fusing roller in an eighth embodiment of the invention. This eighth embodiment is an embodiment in which the distribution of the quantity of heat changes in the lengthwise direction of the fusing roller 10 by varying the magnetic permeability of the cores 23. Specifically, the magnetic permeability of the cores 23 at the edge portion in the lengthwise direction of the fusing roller 10 is larger than the magnetic permeability of the cores 23 at the center portion. In the example in the figure, four coil assemblies 12 are arranged in a line, and the shape of the cores 23 and the coil 22 at each individual coil assembly 12, as well as the winding direction, are all the same. In addition, the wiring connection is such that the same electrical current flows to all the coils 22. However, the magnetic permeability of the cores 23 at the two outside coil assemblies 12, from among the four coil assemblies 12, is larger than the magnetic permeability of the cores 23 at the two inside coil assemblies 12, as explained below.

Because the generated magnetic flux increases as the magnetic permeability of the cores 23 increases, if the magnetic permeability of the cores 23 is made larger, the magnetic flux intertwining with the fusing roller 10 increases, and the quantity of inductively generated heat increases. Conversely, if the magnetic permeability of the cores 23 is made smaller, the magnetic flux intertwining with the fusing roller 10 decreases and the quantity of inductively generated heat becomes smaller. Therefore, even if the winding density of the coil is not changed, the distribution of the quantity of heat generated in the lengthwise direction of the fusing roller 10 can be adjusted as desired by only changing the magnetic permeability of each individual core 23 along the lengthwise direction of the fusing roller 10. Further, the coils 22 can be manufactured with a uniform winding density, thereby enhancing the ability to efficiently mass-produce the coils 22.

Since the magnetic permeability of the cores at the two outside coil assemblies 12 is larger than the magnetic permeability of the cores at the two inside coil assemblies 12, the distribution of the quantity of heat generated in the lengthwise direction of the fusing roller 10 is as shown in FIG. 17C. Assuming this type of distribution of the quantity of heat generated, even though the edge portion in the lengthwise direction of the fusing roller 10 is easily influenced by heat radiation, the temperature distribution in the lengthwise direction of the fusing roller 10 can be made almost uniform, thereby making it possible to achieve uniform fusing characteristics in the lengthwise direction of the fusing roller 10.

The core 23 is preferably a ferrite core, which can include Zn ferrite, Mn-Zn ferrite, Ni-Zn ferrite or Mn-Mg ferrite. The intensity of the spontaneous magnetization of these materials is 400 to 500 G (0.5 to 0.6 $Wb/m^2$) and the cores can be chosen in the lengthwise direction of the fusing roller 10 depending on the properties of each ferrite, namely, the intensity of the spontaneous magnetization, i.e. difference in magnetic permeability.

Moreover, although it is not shown in the figure, the distribution of the quantity of heat generated in the crosswise direction of the fusing belt 30 can be changed by varying the magnetic permeability of the core 33. Further, the distribution of the quantity of heat generated in the lengthwise direction of the heated metal bodies 10, 30 can be changed by changing both the distance between the heated metal bodies (fusing roller 10 or fusing belt 30) and the cores 23, 33 and the magnetic permeability of the cores 23, 33.

A ninth embodiment of the invention is illustrated in FIGS. 22A–22D. This embodiment relates to a fusing device which utilizes a fusing belt 30. In this embodiment, the distance D1 between the cores 33 and the fusing belt 30 is the same for all four of the coil assemblies 34. However, the cores 33 for the two outside assemblies, illustrated in FIG. 22B, are larger than the cores for the two interior assemblies, as illustrated in FIG. 22C. Since a larger core results in increased magnetic field strength, even though the number of windings remains the same, a greater amount of inductive heat will be generated at the outer portions of the fusing belt, relative to the center portion of the belt, as depicted in FIG. 22D. As a result, a uniform fusing action will occur across the width of the fusing belt.

A further related embodiment of the invention is illustrated in FIGS. 23A–23C. In this embodiment, the cores 33 of all of the coil assemblies 34 are of the same size. To provide a greater amount of heat generation at the edges of the fusing belt 30, therefore, the coil assemblies 34 at the outside portions of the belt are positioned closer to the belt than the coil assemblies at the interior. Since the air gap between the cores and the belt is smaller for the outside assemblies, a stronger magnetic field is present at these locations, resulting in greater joule heating. Consequently, the amount of heat which is generated across the width of the belt varies, as shown in FIG. 23C, to compensate for heat loss due to radiation at the edges of the belt.

Figure 24A:
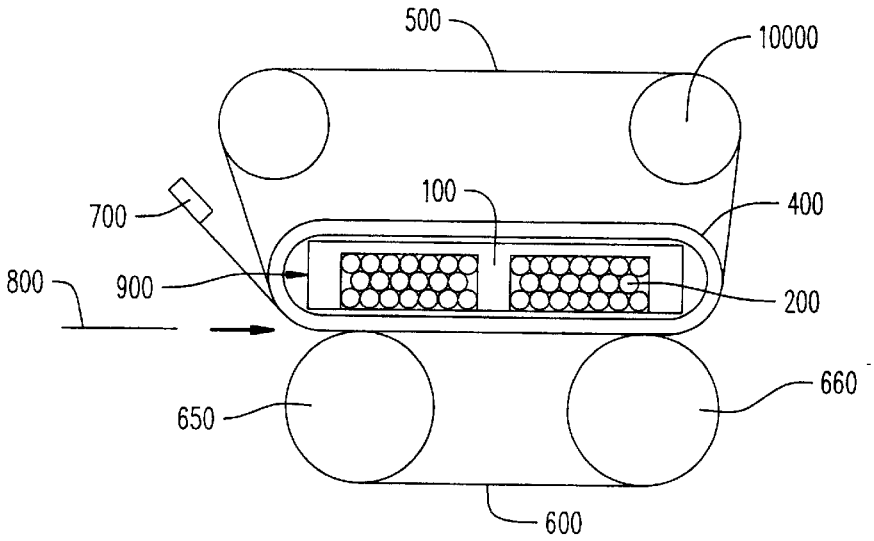
FIGS. 24A and 24B are a side view and a cross-sectional view, respectively, of an alternate form of fusing device which utilizes a fusing belt.
Figure 24B:
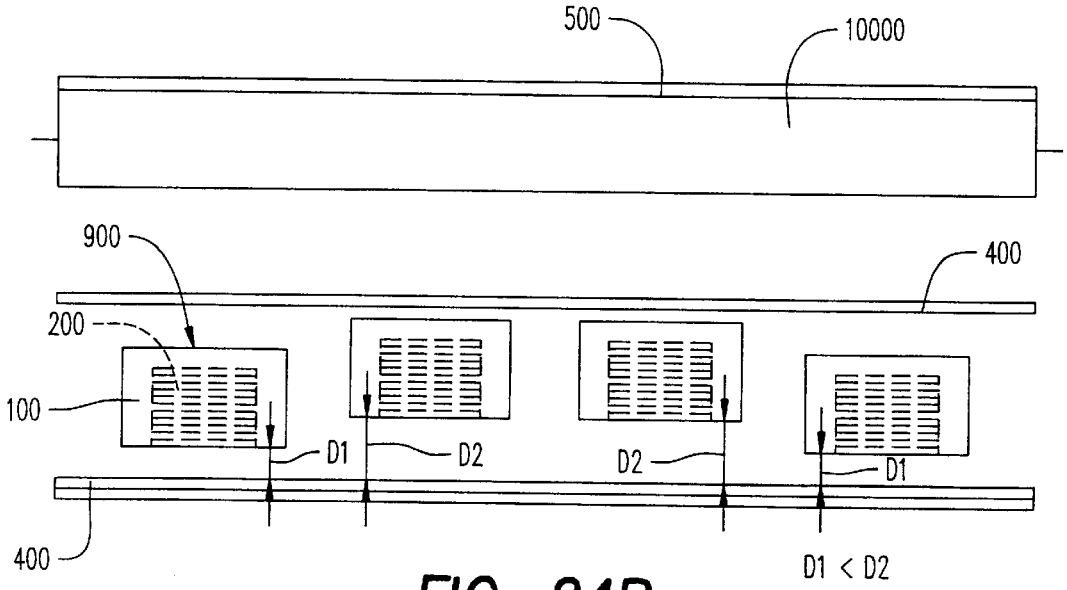

Another embodiment of an inductive fusing device which employs a belt is illustrated in FIGS. 24A and 24B. In this embodiment, the inductive heat generation does not occur within the belt itself. Rather, a magnetic field is generated by coil assemblies 900 each comprised of a three-legged core 100 whose center leg is surrounded by a coil 200. The coil assemblies are contained within a housing 400 made of a conductive material such as copper. The conductive housing forms a closed magnetic circuit with the coil assemblies 900, and becomes heated by the joule effect, in accordance with the principle described previously.

A fusing belt 500 is located on the outside of the housing 400, and engages the lower surface of the housing. As a result, it becomes heated along the portion where the belt and the housing are in contact with one another. The belt 500 is driven in a path around the housing 400 by a driving roller 10000. As illustrated in FIG. 24A, the belt 500 moves in a counterclockwise direction. A pressing belt 600 is driven in a path around a pair of rollers 650 and 660, and contacts the fusing belt 500 along the portion of its length where it engages the housing 400. In the view of FIG. 24A, the pressing belt 600 moves in a clockwise direction.

In operation, a sheet of paper 800, or similar record medium bearing a toner image, is fed into the nip between the fusing roller 500 and the pressing roller 600. As the paper passes from left to right, as viewed in FIG. 24A, it becomes heated by the inductive heating action of the coil assemblies 900 and the conductive housing 400, to thereby fuse the toner image on the paper. To prevent overheating of the paper, a temperature sensor 700, such as a thermistor, contacts the fusing belt 500 at a point where it engages the conductive housing, and regulates the power provided to the coils 200, as described previously.

Referring to FIG. 24B, the coil assemblies 900 all have the same size. However, they are positioned such that the assemblies near the outer edges of the housing 400 are positioned at a distance D1 which is closer to the lower surface of the housing, i.e., the surface which engages the belt 500, than the distance D2 between the housing and the interior coil assemblies. For the reasons explained previously, a greater amount of heat will be generated at the edges of the housing, and hence the edges of the belt 500, to compensate for heat loss due to radiation.

Figure 25:
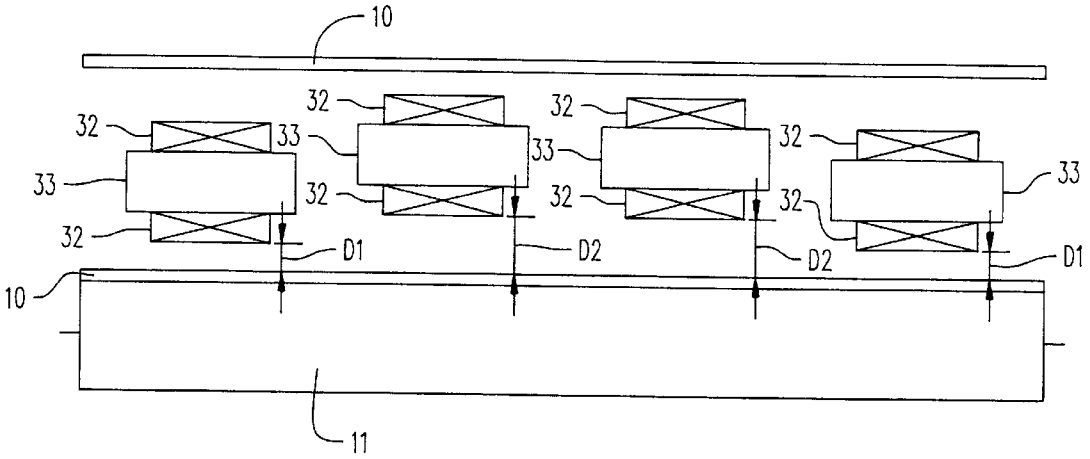
FIG. 25 is a side view of a fusing roller and the magnetic core assemblies in another embodiment of the invention.

A similar arrangement can be employed in a fusing device which employs a fusing roller 10. Referring to FIG. 25, all of the coil assemblies within the fusing roller 10 have cores 33 which are of the same size, for ease of manufacture. The coil assemblies near the ends of the fusing roller 10 are positioned at a distance D1 from the portion of its surface which contacts the pressing roller 11. In contrast, the coil assemblies at the interior of the fusing roller 10 are located a greater distance D2 from this portion of the surface. As a result, in the area of the nip between the rollers 10 and 11 where fusing takes place, a greater amount of heat is generated at the ends of the roller, to provide uniform heating across the width of the fusing roller 10.

Figure 26:
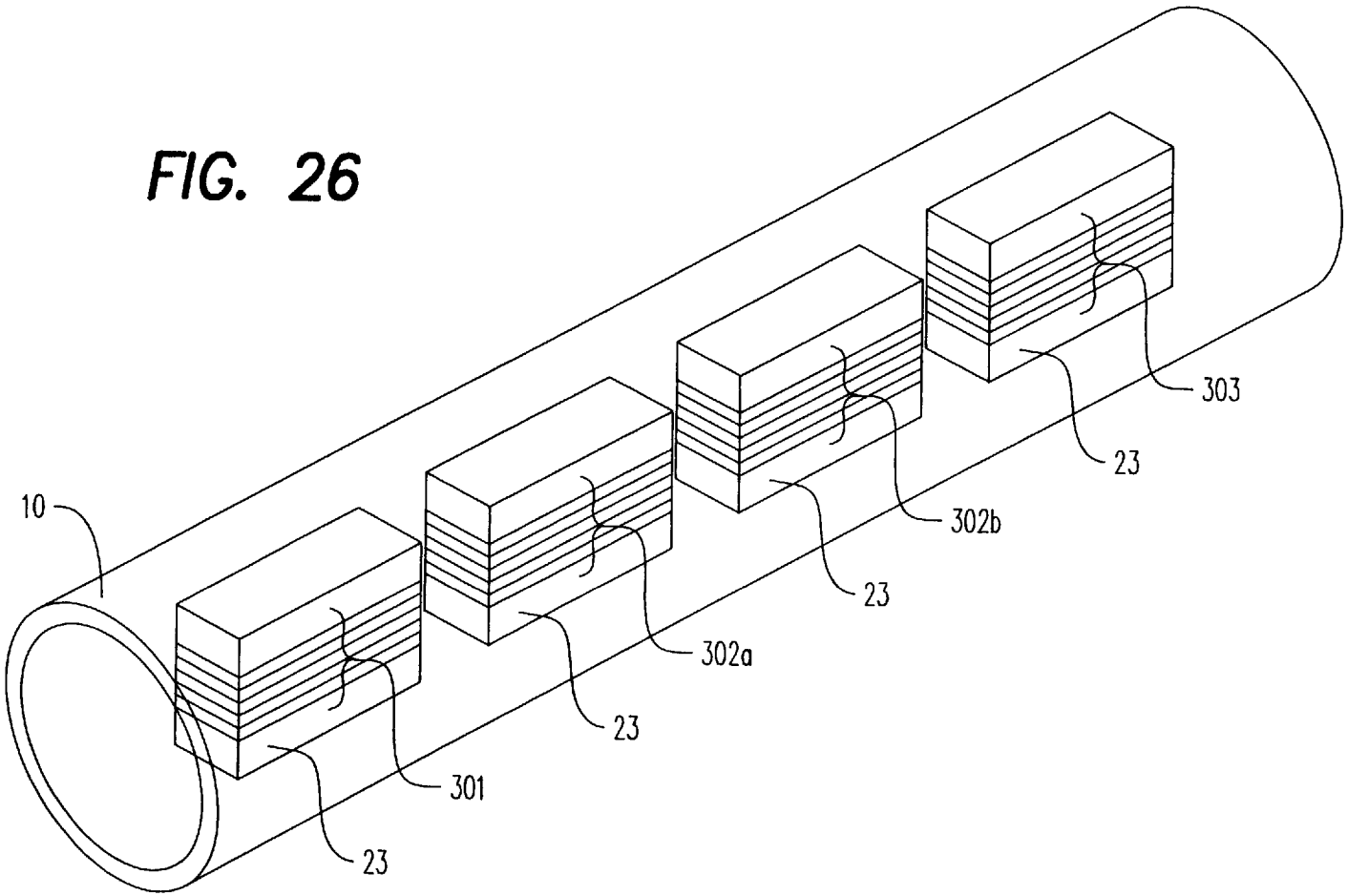
FIG. 26 is a perspective view for explaining an embodiment of the induction heat fusing device of the present invention which employs parallel and serial connected coils.

In the preceding embodiments of the invention, the variation in the inductively generated heat is achieved by changing physical parameters of the magnetic circuit, e.g. the distance of the cores from the heated metal body, the permeability of the cores, and/or the size of the cores. In another approach, the electrical characteristics of the circuit connecting the cores to one another can be arranged to accomplish a similar result. For example, as shown in FIG. 26, coils 301, 302*a*, 302*b* and 303 are wound around a plurality of prismatic cores 23 inside a fusing roller 10. The coils 302*a* and 302*b* arranged at the center portion of the fusing roller 10 are connected in parallel to each other, while the coils 301 and 303 arranged at the end portions of the fusing roller 10 are connected in series with the coils 302*a* and 302*b*.

Figure 27:
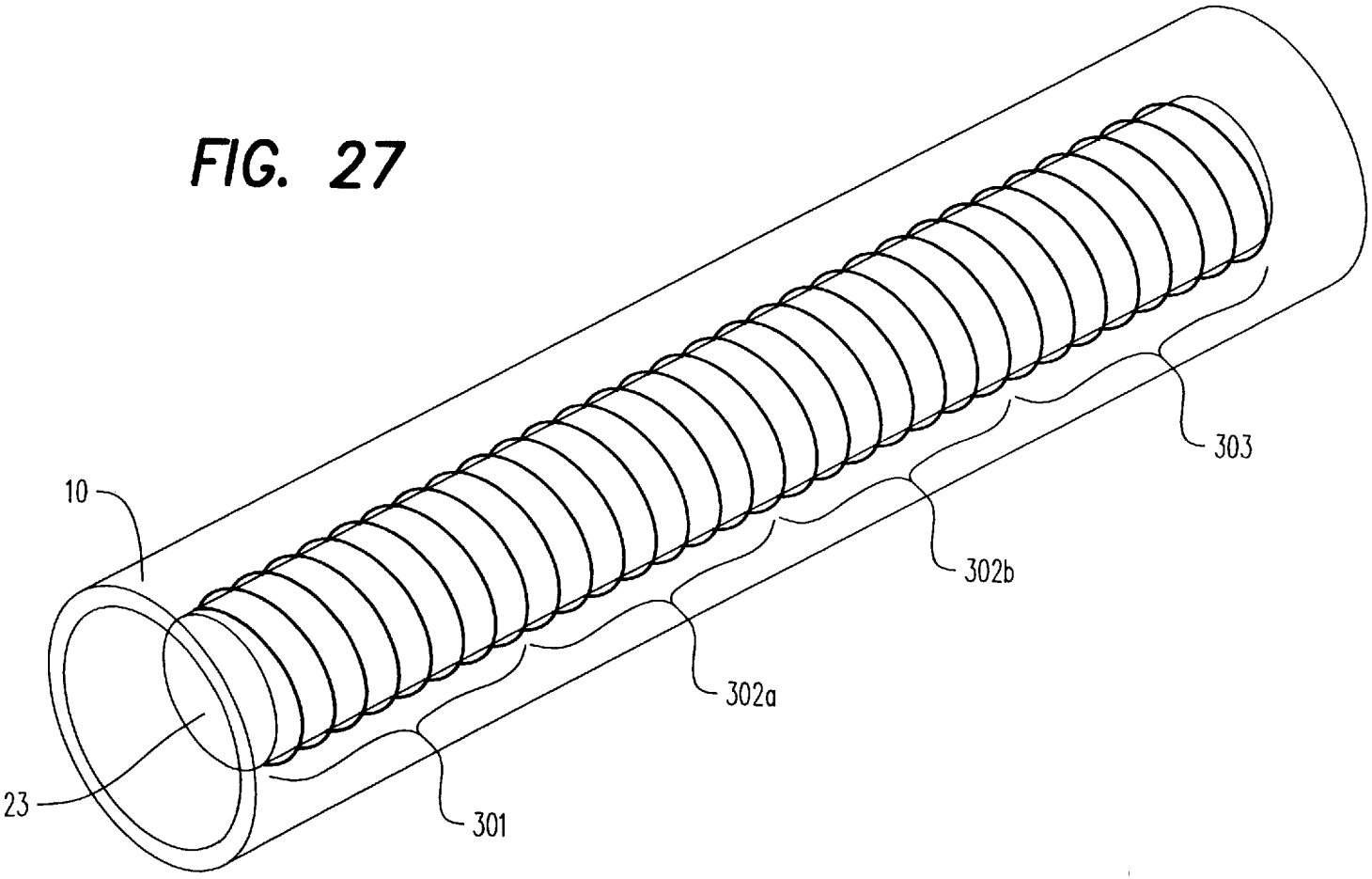
FIG. 27 is a perspective view for explaining another embodiment of the induction heat fusing device of the present invention which employs parallel and serial connected coils.
Figure 28:
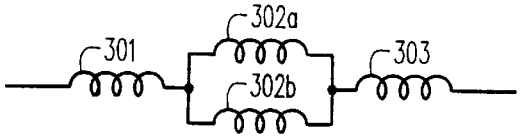
FIG. 28 is a schematic circuit diagram for explaining an embodiment of the induction heat fusing device of the present invention which employs parallel and serial connected coils.
Figure 29A:
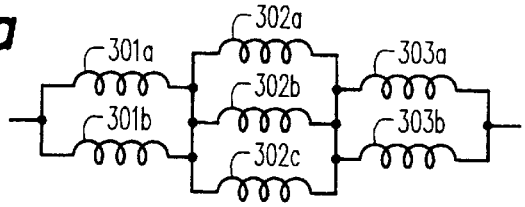
FIGS. 29(*a*) through 29(*d*) are schematic diagrams for explaining other embodiments of the induction heat fusing device of the present invention which employs parallel and serial connected coils.
Figure 29B:
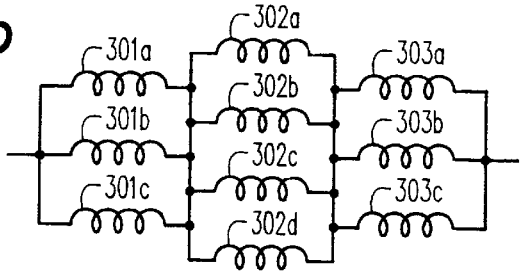
Figure 29C:
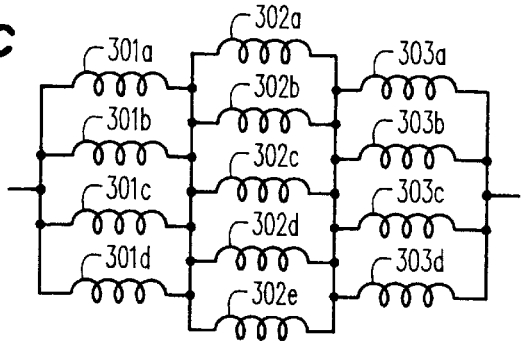
Figure 29D:
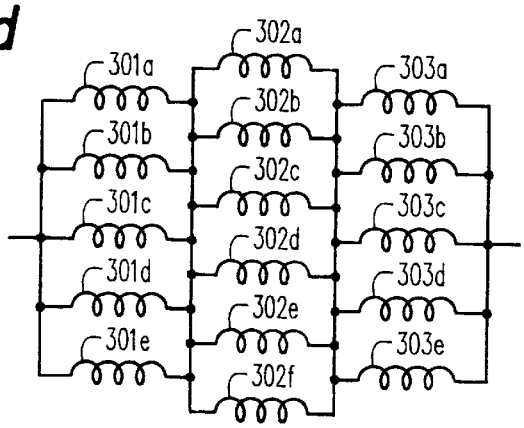

Alternatively, as shown in FIG. 27, a plurality of coils 301, 302*a*, 302*b* and 303 are helically and uniformly wound around one cylindrical core 23, where the coils 302*a* and 302*b* arranged at the center portion of the fusing roller 10 are connected in parallel to each other, while the coils 301 and 303 arranged at the end portions of the fusing roller 10 are connected in series with the coils 302*a* and 302*b*. In this case, each coil is wound with a uniform winding density. The above coil arrangement is shown in FIG. 28 in the form of a schematic diagram.

In various embodiments the number of coils is changed, which can be exemplified by a variety of schematic diagrams as follows. As shown in FIG. 29(*a*), there may be a coil arrangement in which three coils 302*a*, 302*b* and 302*c* are connected in parallel to each other at the center portion, and coils 301*a* and 301*b* as well as coils 303*a* and 303*b* are connected in parallel to each other at the end portions to be connected in series with the coils at the center portion. As shown in FIG. 29(*b*), there may be a coil arrangement in which four coils 302*a* through 302*d* are connected in parallel to each other at the center portion, and three coils 301*a* through 301*c* as well as coils 303*a* through 303*c* are connected in parallel to each other at the end portions. These end coils are further connected in series with the coils at the center portion. As shown in FIG. 29(*c*), there may be a coil arrangement in which five coils 302*a* through 302*e* are connected in parallel to each other at the center portion, and four coils 301*a* through 301*d* as well as coils 303*a* through 303*d* are connected in parallel to each other at the end portions. The end coils are further connected in series with the coils at the center portion. As shown in FIG. 29(*d*), there may be a coil arrangement in which six coils 302*a* through 302*f* are connected in parallel to each other at the center portion, and five coils 301*a* through 301*e* as well as coils 303*a* through 303*e* are connected in parallel to each other at the end portions. The end coils are further connected in series with the coils at the center portion.

When connecting the coils arranged at the center portion of the fusing roller 10 in parallel to each other and connecting the coils arranged at the end portions in series with the coils at the center portion, the number of coils connected in parallel to each other at the center portion is larger than the number of the coils in each end portion, as described in detail later. With this arrangement, the amount of current generated in the coils at the center portion is smaller than that in the coils arranged at the end portions. Therefore, the induction current at the center portion is smaller, so that the amount of heat generated at the center portion is smaller and the amount of heat generated at the end portions is larger. Consequently, the heated body has an almost uniform temperature distribution. At the center portion, the heat discharge amount is smaller and almost the entire electric field is used for the heat generation. At the end portions, the heat discharge amount is larger and a part of the electric field is formed outside the roller.

With regard to the relation between the plurality of coils and the cores around which the coils are wound, it is acceptable to wind each coil around each core as shown in FIG. 26 while increasing the number of coils that are connected in parallel to each other at the center portion and decreasing the number of coils connected in parallel to each other at the end portions, or to wind a plurality of coils around one core while arranging a larger number of coils connected in parallel to each other at the center portion and arranging a smaller number of coils connected in parallel to each other at the end portions, as in the embodiment of FIG. 27.

Figure 30:
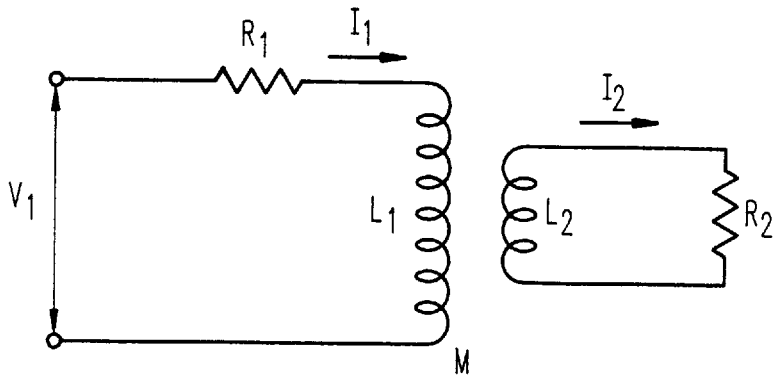
FIG. 30 is an equivalent schematic circuit diagram showing the relation between a fusing roller and a coil.

The changes in the heat generation amount according to each coil arrangement achieved by combining the parallel connection with the series connection of the coils will now be described. FIG. 30 is an equivalent schematic circuit diagram showing the relation between the fusing roller and the coils. In this figure and the following equations, L1 is the inductance of the coil, R1 is the resistance of the coil, L2 is the inductance of the fusing roller, R2 is the resistance of the fusing roller, V is a voltage to be applied to the coil, I1 is a current flowing through the coil, I2 is a current flowing through the fusing roller (induction current), M is a mutual inductance and k is a coupling constant. In the illustrated equivalent circuit, the following equations (1) through (3) hold.

$$V_1=(R_1+j\omega L_1)I_1+j\omega MI_2 \quad (1)$$

$$O=j\omega MI_1+(R_2+j\omega L_2)I_2 \quad (2)$$

$$k=M/\sqrt{L_1L_2} \quad (3)$$

The current flowing through the fusing roller can be obtained from the above equations, yielding the following equation (4).

$$O_2=-J\omega MI_1/R_2+j\omega L_2=-j\omega k\sqrt{L_1L_2}\ I_1/(R_2+j\omega L_2) \quad (4)$$

Both the members of equation (4) are squared to obtain the following equation (5).

$$I_2^2=\omega^2k^2L_1L_2I_1^2/(R_2+j\omega L_2)^2 \quad (5)$$

The heat generation amount of the fusing roller, W2, can be obtained from the following equation (6).

$$W_2I_2^2R_2=\omega^2k^2L_2R_2/(R_2+j\omega L_2)^2L_1I_1^2 \quad (6)$$

where ω, k, $L_2$ and $R_2$ are constants depending on the material and the shape of the fusing roller, and therefore, they can be set as in the following equation (7).

$$K=\omega^2 k^2 L_2 R_2/(R_2+j\omega L_2)^2 \quad (7)$$

Therefore, the heat generation amount $W_2$ of the fusing roller can be obtained from the following equation (8), and it can be seen from equation (8) that the heat generation amount of the fusing roller is proportional to the inductance of the coil and the square of the coil current.

$$W_2=K\cdot L1\cdot I_1^2 \quad (8)$$

By means of equation (8), the heat generation amount of the fusing roller is obtained from the coils according to the aforementioned connection methods shown in FIG. 28 and FIGS. 29(*a*) through 29(*d*). It is assumed in the following equations that a current flowing through each coil arranged at the center portion is Ia, a current flowing through each coil arranged at the end portions is Ib, the heat generation amount obtained from each coil arranged at the center portion is Wa, and the heat generation amount obtained from each coil arranged at the end portions is Wb.

First, in the case of the connection shown in FIG. 28, the currents flowing through the coils at the center portion and the coils at the end portions have the relation of 2×Ia=Ib according to the connection. Further, according to equation (8), the heat generation amount obtained from each coil arranged at the center portion is:

Wa=K×L×Ia×Ia, and likewise, the heat generation amount obtained from each coil arranged at the end portions is:

Wb=K×L×Ib×Ib. Therefore, the relation between Wa and Wb is:

Wa=4×Wb, namely the heat generation amount per coil at the end portions is four times as great as the heat generation amount per coil at the center portion.

Next, in the case of the connection shown in FIG. 29(*a*), the currents flowing through the coils at the center portion and the coils at the end portions have the relation of 3×Ia=2×Ib according to the connection. Further, according to equation (8), the heat generation amount obtained from each coil arranged at the center portion is:

Wa=K×L×Ia×Ia, and the heat generation amount obtained from each coil arranged at the end portions is:

Wb=K×L×Ib×Ib. Therefore, the relation between Wa and Wb is:

Wa=9/4×Wb, namely the heat generation amount per coil at the end portions is 9/4 times as great as the heat generation amount per coil at the center portion.

Next, in the case of the connection shown in FIG. 29(*b*), the currents flowing through the coils at the center portion and the coils at the end portions have the relation of 4×Ia=3×Ib according to the connection. Further, according to equation (8), the heat generation amount obtained from each coil arranged at the center portion is:

Wa=K×L×Ia×Ia, and likewise, the heat generation amount obtained from each coil arranged at the end portions is:

Wb=K×L×Ib×Ib. Therefore, the relation between Wa and Wb is:

Wa=16/9×Wb, namely the heat generation amount per coil at the end portions is 16/9 times as great as the heat generation amount per coil at the center portion.

Next, in the case of the connection shown in FIG. 29(*c*), the currents flowing through the coils at the center portion and the coils at the end portions have the relation of 5×Ia=4×Ib according to the connection. Further, according to equation (8), the heat generation amount obtained from each coil arranged at the center portion is:

Wa=K×L×Ia×Ia, and likewise, the heat generation amount obtained from each coil arranged at the end portions is:

Wb=K×L×Ib×Ib. Therefore, the relation between Wa and Wb is:

Wa=25/16×Wb, i.e. the heat generation amount per coil at the end portions is 25/16 times as great as the heat generation amount per coil at the center portion.

Next, in the case of the connection shown in FIG. 29(*d*), the currents flowing through the coils at the center portion and the coils at the end portions have the relation of 6×Ia=5×Ib according to the connection. Further, according to equation (8), the heat generation amount obtained from each coil arranged at the center portion is:

Wa=K×L×Ia×Ia, and likewise, the heat generation amount obtained from each coil arranged at the end portions is:

Wb=K×L×Ib×Ib. Therefore, the relation between Wa and Wb is:

Wa=36/25×Wb, such that the heat generation amount per coil at the end portions is 36/25 times as great as the heat generation amount per coil at the center portion.

The heat generation amount of the coils at the center portion and the heat generation amount of the coils at the end portions can be thus controlled in various ways according to each connection method.

In an induction heat fusing device according to one embodiment of the invention as described above, the heat generating efficiency is increased and the distribution of the quantity of heat generated in the lengthwise direction of the heated metal bodies can be freely set by utilizing a simple construction in which a magnetic flux is generated in a direction at a right angle to the heated metal bodies and the distance between the heated metal bodies and the cores is changed. Because the coils are manufactured with a uniform winding density, the ability to mass-produce coils is enhanced.

Furthermore, the temperature distribution in the lengthwise direction of the heated metal bodies can be made almost uniform, considering the effects of heat radiation, thereby making it possible to achieve uniform fusing characteristics in the lengthwise direction of the heated metal bodies.

Furthermore, according to an alternate embodiment of the invention, the heat generating efficiency is increased and the distribution of the quantity of heat generated in the lengthwise direction of the heated metal bodies can be freely set by utilizing a simple construction in which a magnetic flux is generated in a direction at a right angle to the heated metal bodies and the magnetic permeability of the cores is changed. Again, because the coils are manufactured with a uniform winding density the ability to mass-produce coils is improved.

In yet another embodiment of the invention, the effects of heat loss due to radiation can be compensated by varying the size of the cores which are used to generate the magnetic field that causes inductive heating. Again, uniform winding density is utilized, to facilitate mass production of the coils.

According to another embodiment of the present invention, the heating temperature of the heated body can be made uniform merely by changing the connection method of the plurality of coils. As such, there is no requirement to wind the coil in a special winding manner, and consequently a high productivity is assured. Furthermore, it is possible to greatly vary the heat generation amount since there is no restriction in terms of shape, and this allows the heat generation amount to be easily corrected even when there is a great temperature decrease due to the heat discharge at the end portions of the heated body.

It will be appreciated, of course, that although the various embodiments of the invention have been described individually, they can be combined in various manners to achieve a desired variation in heat generation along the length of the heated metal body.

What is claimed is:

1. An induction heat fixing device comprising:

a heat member formed by an electrically conductive member and having a hollow space in its interior;

a pressure member disposed in pressing contact with the heat member;

a plurality of cores disposed within the heat member, at least some of said cores having a tapered surface which faces the heat member and being disposed such that the distance between the tapered surface of the cores and the interior surface of the heat member is greater in a direction toward the center of the heat member and less in a direction toward an edge of the heat member;

coils provided around the cores; and means for passing an alternating current through the coils.

2. An induction heat fixing device comprising:

a heat member formed by an electrically conductive member and having a hollow space in its interior;

a pressure member disposed in pressing contact with the heat member;

a plurality of cores disposed within the heat member;

coils provided around the cores, with the distances between at least some of the coils and the interior surface of the heat member being different from each other; and means for passing an alternating current through the coils.

3. An induction heat fixing device comprising:

a heat member formed by an electrically conductive member and having a hollow space in its interior;

a pressure member disposed in pressing contact with the heat member;

a plurality of cores disposed within the heat member;

coils provided around the cores, said coils being sequentially connected in order to form a parallel connection and a series connection; and means for passing an alternating current through the coils.

4. The induction heat fixing device of claim 3 wherein said coils include a first set of coils connected in parallel with one another, a second coil set connected in series with said first set of coils on one side thereof, and a third coil set connected in series with said first set of coils on the opposite side thereof.

5. The induction heat fixing device of claim 4 wherein each of said second and third coil sets contains a plurality of coils connected in parallel with one another.

6. The induction heat fixing device of claim 5 wherein the number of coils in said first set is one greater than the number of coils in each of said second and third sets.

7. The induction heat fixing device of claim 4 wherein the number of coils in said first set is one greater than the number of coils in each of said second and third sets.

8. An induction heat fixing device, comprising:

a heat member formed by an electrically conductive member and having a hollow space in its interior;

a pressure member disposed in pressing contact with the heat member;

a core disposed within the heat member, said core having a tapered surface which is oriented such that the distance between the tapered surface of the core and the interior surface of the heat member is greater in a direction toward the center of the heat member and less in a direction toward an edge of the heat member;

a coil provided around the core; and means for passing an alternating current through the coil.

9. An induction heat fixing device comprising:

a heat member formed by an electrically conductive member and having a hollow space in its interior;

a pressure member disposed in pressing contact with the heat member;

a plurality of cores disposed within the heat member, with the lengths of at least some of the cores being different from each other:

coils provided around the cores; and, means for passing an alternating current through the coils; wherein at least some of said cores have a tapered surface which faces the heat member and are disposed such that the distance between the tapered surface of the cores and the interior surface of the heat member is greater in a direction toward the center of the heat member and less in a direction toward an edge of the heat member.

* * * * *